US008834196B2

(12) United States Patent
Duran et al.

(10) Patent No.: US 8,834,196 B2
(45) Date of Patent: Sep. 16, 2014

(54) SHIELDED MODULAR JACK ASSEMBLY

(75) Inventors: Jaime Duran, Chicago, IL (US); Jeng-De Lin, Yorkville, IL (US)

(73) Assignee: Molex Incorporated, Lisle, IL (US)

( * ) Notice: Subject to any disclaimer, the term of this patent is extended or adjusted under 35 U.S.C. 154(b) by 346 days.

(21) Appl. No.: 13/498,464

(22) PCT Filed: Sep. 28, 2010

(86) PCT No.: PCT/US2010/050514

§ 371 (c)(1), (2), (4) Date: Jun. 6, 2012

(87) PCT Pub. No.: WO2011/038387

PCT Pub. Date: Mar. 31, 2011

(65) Prior Publication Data

US 2012/0244736 A1 Sep. 27, 2012

Related U.S. Application Data

(60) Provisional application No. 61/246,383, filed on Sep. 28, 2009.

(51) Int. Cl.

| | |
|---|---|
| ***H01R 13/58*** | (2006.01) |
| ***H01R 9/03*** | (2006.01) |
| ***H01R 13/6592*** | (2011.01) |
| ***H01R 24/64*** | (2011.01) |

(52) U.S. Cl.

CPC ..... *H01R 9/032* (2013.01); *H01R 13/5812* (2013.01); *H01R 13/6592* (2013.01); *H01R 13/5829* (2013.01); *H01R 24/64* (2013.01); *H01R 13/5804* (2013.01)

USPC ..... 439/459; 439/467; 439/607.43

(58) Field of Classification Search

CPC ..... H01R 13/6592; H01R 13/5812; H01R 13/5829

USPC ..... 439/459, 460, 465, 467, 463, 607.41, 439/607.43

See application file for complete search history.

(56) References Cited

U.S. PATENT DOCUMENTS

| | | | | |
|---|---|---|---|---|
| 6,731,510 | B1 | 5/2004 | Hwang et al. | |
| 7,025,621 | B2 * | 4/2006 | Mossner et al. | 439/460 |
| 7,114,987 | B2 * | 10/2006 | Nad | 439/470 |
| 7,476,120 | B2 * | 1/2009 | Patel et al. | 439/460 |
| 7,955,120 | B2 * | 6/2011 | Patel et al. | 439/460 |
| 8,109,784 | B2 * | 2/2012 | Patel et al. | 439/460 |
| 8,376,779 | B2 * | 2/2013 | Metral et al. | 439/607.41 |
| 2007/0141892 | A1 | 6/2007 | Gula | |
| 2013/0189873 | A1 * | 7/2013 | Maranto et al. | 439/460 |

OTHER PUBLICATIONS

International Search Report for PCT/US2010/050514, Jan. 11, 2011.

* cited by examiner

*Primary Examiner* — Felix O Figueroa
(74) *Attorney, Agent, or Firm* — Timothy M. Morella

(57) ABSTRACT

An electrical connector has a conductive member with a conductor receiving shoulder to at least partially define a conductor receiving receptacle at which a conductor may be positioned and a movable conductor engaging member configured for movement along a first path. At one position along the first path, the conductor is engaged between the conductor receiving shoulder and the conductor engaging member. The conductor engaging member also moves along a second path that intersects with the first path. At one of the positions along the second path, the conductor engaging member is retained to permit insertion of a conductor into the conductor receiving receptacle.

36 Claims, 19 Drawing Sheets

SHIELDED MODULAR JACK ASSEMBLY

REFERENCES TO RELATED APPLICATIONS

The Present Application claims priority to previously-filed U.S. Provisional Patent Application No. 61/246,383, entitled "Shielded Modular Jack Assembly," and filed with the U.S. Patent and Trademark Office on 28 Sep. 2009. The contents of previously-filed Application are fully incorporated herein in its entirety.

BACKGROUND

The disclosure herein generally relates to modular jack electrical connectors and, more particularly, to shielded modular jack assemblies that engage the shield of a shielded cable.

DESCRIPTION OF THE RELATED ART

Electrical connectors known as modular jacks typically include an insulative housing having a receptacle in which a plurality of conductive, resilient contacts or terminals are positioned to engage the conductive contacts or terminals of a mating plug, which are inserted into the receptacle. In one type of modular jack, the contacts are connected or terminated to cables having a plurality of twisted-pair wires. As data rates and signal speeds have increased, it has become more prevalent to utilize shielded twisted-pair cables in which the cable having the plurality of twisted-pair wires additionally has an outer conductive shield surrounding the twisted-pairs of wires. Further, when using shielded twisted-pair cables, it is desirable to include conductive shielding around the outer portion of the modular jack housing and a structure to establish a good electrical connection between a conductive housing of the connector and the shield of a cable inserted into the housing.

The type of modular jacks that are generally terminated to cables are typically terminated in the field rather than at a factory. Accordingly, simplicity in making the connection between the cable shield and connector shield is desirable. Currently-known shielded modular jack connectors use cable ties wrapped around the housing in order to force the cable shield into contact with the conductive housing. Other prior art designs use cable ties to engage both a portion of the conductive housing and an exposed portion of the cable shield in order to establish contact between the conductive housing and the cable shield. Still other designs have spring-loaded clamps that engage the exposed cable shield and force the cable shield into engagement with the conductive housing of the modular jack. Such existing spring-loaded clamps typically have many components which can make manufacturing the modular jacks difficult and expensive and/or are somewhat cumbersome to assemble onto the shielded cable.

SUMMARY

Accordingly, it is an object to solve the above-described problems encountered with existing shielded modular jack connectors by providing an improved cable clamping structure. More specifically, a field-terminable electrical connector includes an insulative housing member, a plurality of conductive terminals mounted to the housing member for interconnection to a plurality of inner wires, a conductive ground member and a cable receptacle for engaging the exposed conductive shield of the cable. The cable receptacle may be defined in part by a conductive shoulder electrically connected to the conductive ground member. A movable clamping member may be mounted on the ground member and configured for movement along a first path between a first operative position spaced from the cable receptacle and a second operative position adjacent to the cable receptacle and opposed to the conductive shoulder to clampingly engage the exposed conductive shield between the conductive shoulder and the movable clamping member. The movable clamping member may be further configured for movement along a second path intersecting with the first path, the second path including a clamping member retention position at which the clamping member may be retained to permit insertion of the cable into the receptacle. A biasing member biases the movable clamping member towards the cable receptacle, and a latching structure interacts with the movable clamping member to retaining the movable clamping member at the retention position.

If desired, the movable clamping member may be conductive and include an arcuate surface for engaging the cable. The latching structure may include a retention shoulder and the biasing member may be configured to further bias the clamping member against the shoulder in order to retain the clamping member in the open position. The movable clamping member may move along a first path between a first operative position spaced from the cable receptacle and the engagement position, the movable clamping member may be configured for further movement along a second path intersecting with the first path, with the second path including the open position. The first path may be generally linear. The clamping member may be retained at the open position at an angle to the first path. The movement of the clamping member from the open position to the first operative position may include pivotal movement. The clamping member may move along the second path between the first operative position spaced from the cable receptacle and the open position. The ground shield may include a clamp receptacle for receiving the clamping member and biasing member therein, with the clamp receptacle having first and second openings on opposite sides thereof. The first opening may be configured to permit insertion of the clamping member into the clamp receptacle and the second opening may be configured to permit insertion of the biasing member into the clamp receptacle. The conductive shoulder may be integrally formed with and fixed relative to the conductive ground member. The conductive shoulder may be arcuate.

The electrical connector may include an insulative inner housing member and a plurality of conductive terminals mounted to the housing member for interconnection to the plurality of inner wires. A conductive ground shield at least partially surrounds the housing member and has a cable receiving shoulder to at least partially define a cable receiving receptacle at which the exposed section of the outer conductive shield of the cable may be positioned. A movable shield engaging member may be configured for movement along a first path between a first operative position spaced from the cable receiving receptacle and a second operative position adjacent to the cable receiving receptacle and opposed to the cable receiving shoulder to engage the cable shield between the cable receiving shoulder and the movable shield engaging member. The movable shield engaging member may be further configured to move along a second path between a third operative position at which the movable shield engaging member may be retained to permit insertion of a cable into the cable receiving receptacle and a fourth operative position at which the first and second paths intersect. A retention shoulder may be provided, and a biasing member biases the movable shield engaging member towards the cable receiving receptacle and biases the shield engaging member against the retention shoulder in order to retain the shield engaging member at the third operative position.

If desired, the cable receiving shoulder may be arcuate. The movable shield engaging member may be conductive and may be configured to engage a portion of the exposed conductive shield of the cable. The movable shield engaging member may include an arcuate surface for engaging the cable. The first path may be generally linear. The shield engaging member may be retained at the retention position at an angle to the first path. The movement of the shield engaging member from the retention position to the first operative position may include pivotal movement.

In another form, an electrical connector may include a conductive member with a conductor receiving shoulder to at least partially define a conductor receiving receptacle at which a conductor may be positioned and a conductive, movable conductor engaging member may be configured for movement along a first path between a first operative position spaced from the conductor receiving receptacle and a second operative position adjacent to the conductor receiving receptacle and opposed to the conductor receiving shoulder to engage the conductor between the conductor receiving shoulder and the movable conductor engaging member. The movable conductor engaging member may be further configured for movement along a second path between a third operative position at which the movable conductor engaging member is retained to permit insertion of a conductor into the conductor receiving receptacle and a fourth operative position at which the first and second paths intersect. A retention shoulder may be provided and a biasing member may bias the movable conductor engaging member towards the conductor receiving receptacle when the movable conductor engaging member is positioned along the first path and bias the shield engaging member against the retention shoulder in order to retain the shield engaging member at the third operative position.

BRIEF DESCRIPTION OF THE FIGURES

Various other objects, features and advantages of the disclosure will become more fully appreciated and better understood when considered in conjunction with the accompanying figures, in which like-referenced characters designate the same or similar elements throughout the several views, wherein.

DETAILED DESCRIPTION OF THE PREFERRED EMBODIMENTS

The following description is intended to convey the operation of exemplary embodiments of the disclosure to those skilled in the art. It will be appreciated that this description is intended to aid the reader, not limit the disclosure. As such, references to a feature or aspect are intended to describe the feature or aspect of an embodiment of the disclosure, not to imply that every embodiment of the disclosure must have the described characteristic.

Figure 1:
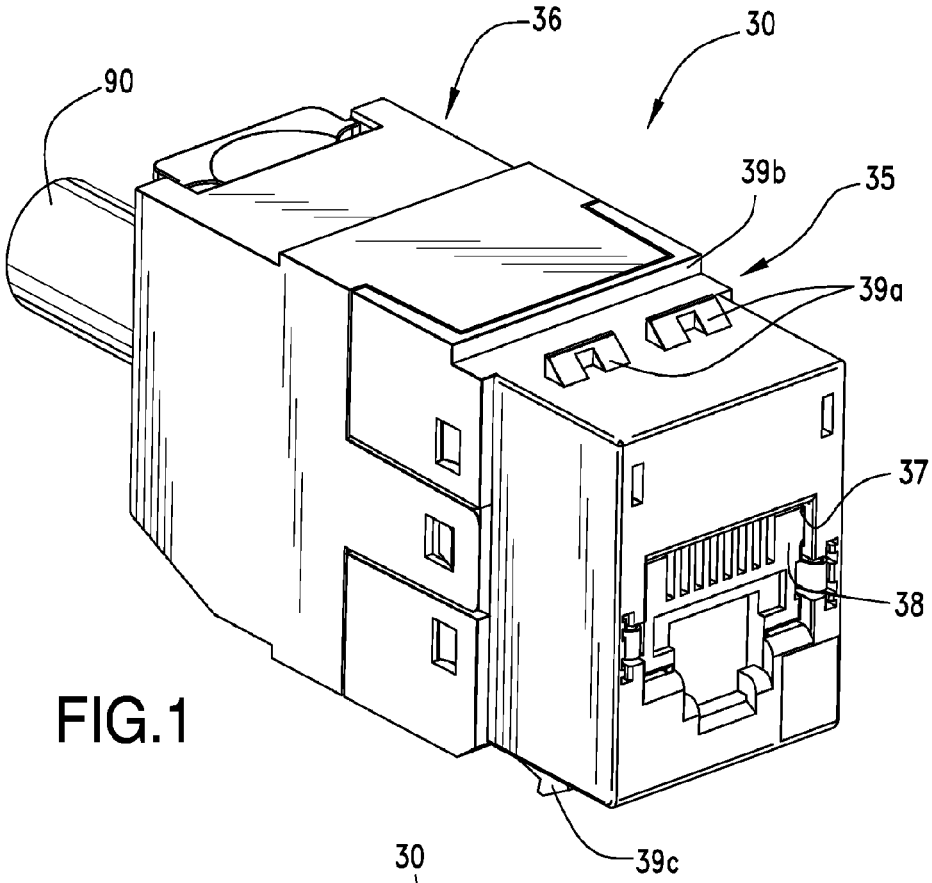
FIG. 1 is a front perspective view of one embodiment of a shielded modular jack connector assembly including a cable clamping structure of the disclosure terminated to a shielded twisted-pair cable.
Figure 2:
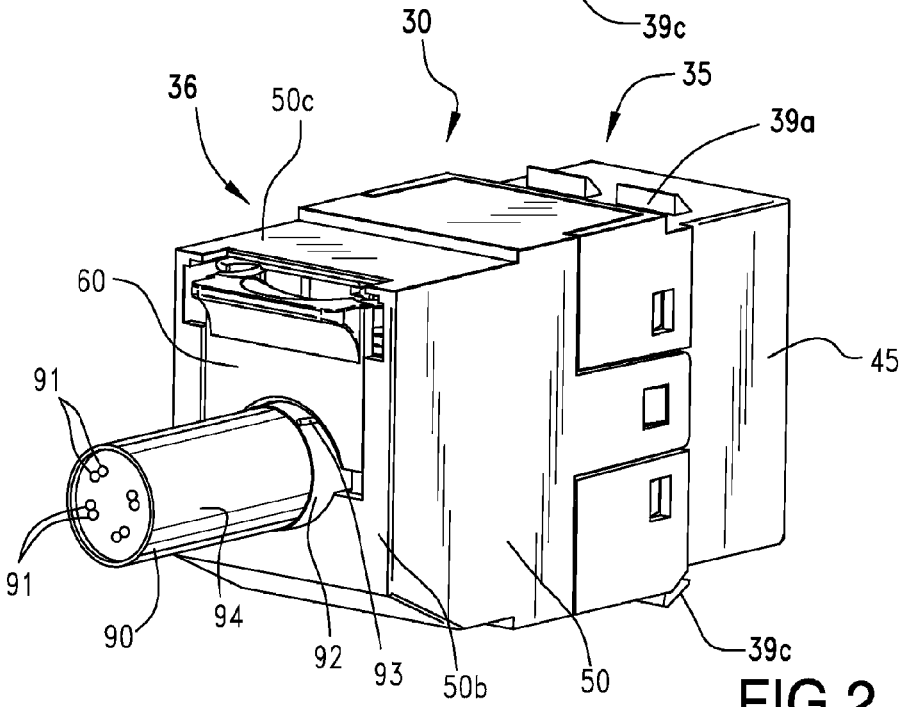
FIG. 2 is a rear perspective view of the shielded modular jack connector assembly of FIG. 1.

Referring to FIGS. 1-2, a modular jack assembly 30 terminated to a shielded cable 90 is depicted. Modular jack assembly 30 includes a front housing assembly 35 and a rear housing or end cap assembly 36. Front housing assembly 35 has a receptacle 37 for receiving a mating plug (not shown) and a moveable shutter 38 positioned within the receptacle. Modular jack assembly 30 is configured for mounting to a panel (not shown) and includes a pair of fixed projections 39*a*, a shoulder 39*b* and a deflectable latch 39*c* to facilitate mounting and removal of jack assembly 30 from the panel.

In this description, representations of directions such as up, down, left, right, front, rear and the like, used for explaining the structure and operation of each component of the disclosed embodiments are not absolute, but relative. These representations are appropriate when each component of the disclosed embodiments is in the position shown in the figures. If the position changes, however, these representations are to be also changed accordingly.

Figure 3:
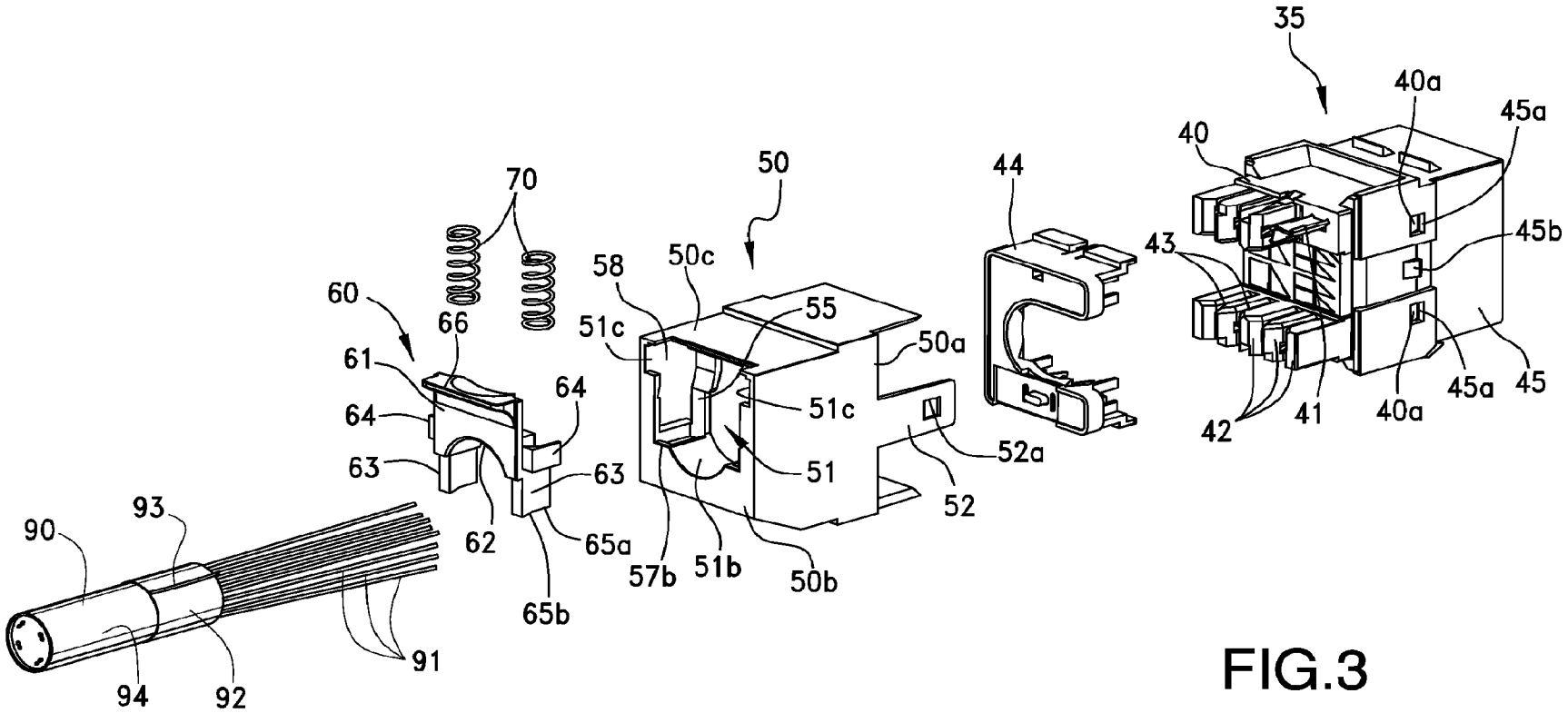
FIG. 3 is an exploded perspective view of the shielded modular jack connector and a shielded twisted-pair cable of FIG. 2 with certain components removed for clarity.

Referring to FIG. 3, front housing assembly 35 includes insulative inner housing 40 in which plurality of conductive terminals 41 are mounted. Two spaced apart rows of five projections 42 extend rearwardly from inner housing 40 to form four slots 43 in which insulation displacement sections of terminals 41 are positioned for subsequent termination to individual wires 91 as is known in the art (two of the projections of the upper row have been removed from FIG. 3 to show the insulation displacement sections of terminals 41). Inner housing 40 is secured to outer shield or ground member 45 of front housing assembly 35 through the use of projections 40*a* on the sides of inner housing 40 that are secured within windows or openings 45*a* in the sides of outer shield 45. Stuffer cap or cover 44 is secured to inner housing 40 and extends over projections 42 after wires 91 have been secured to terminals 41 in order to assist in maintaining the connection between wires 91 and terminals 41. Inner housing 40 and stuffer cap 44 are made of an insulative material such as resin and outer shield 45 is made of a conductive material, but could also be made of a conductive or plated plastic or stamped and formed sheet metal.

Figure 4:
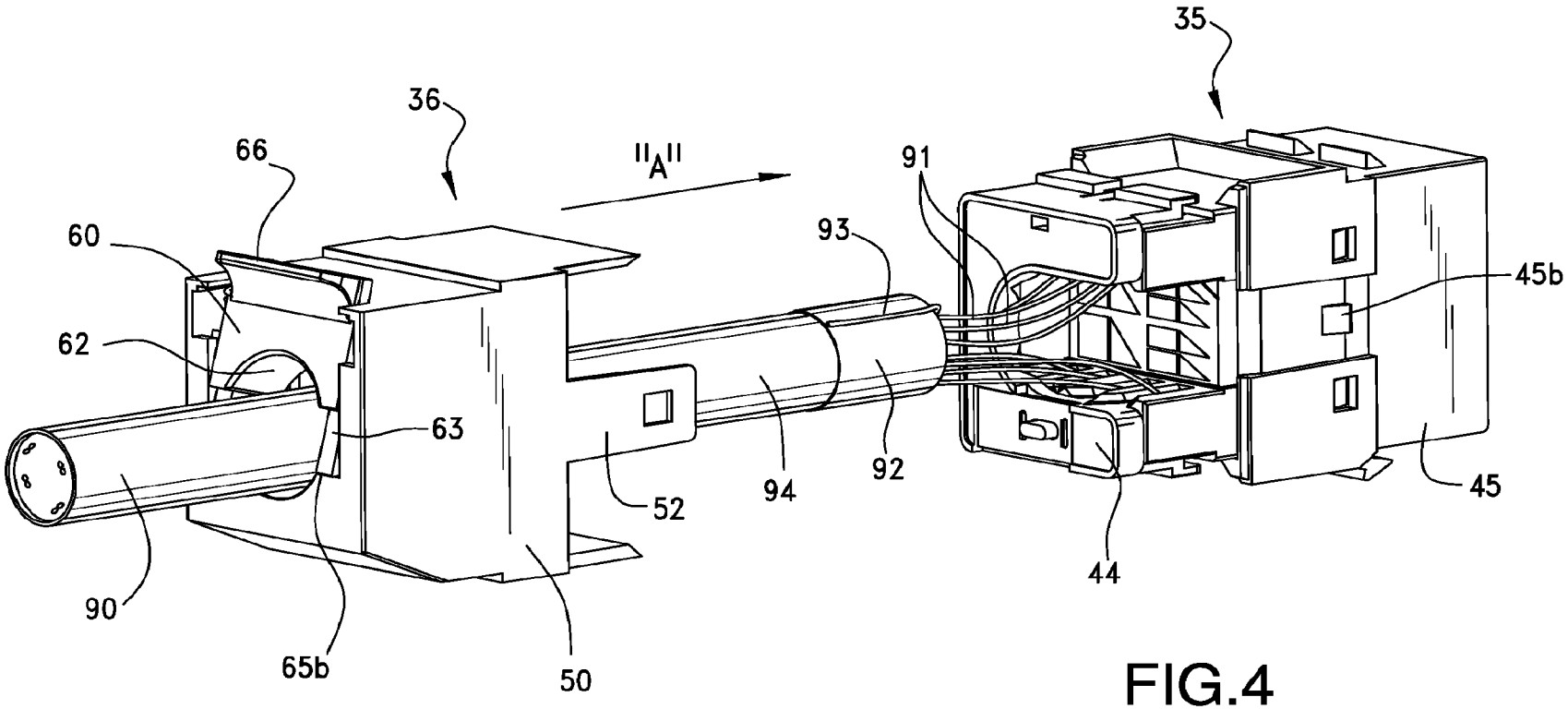
FIG. 4 is a perspective view of the shielded modular jack connector of FIG. 2 with the shielded twisted-pair cable terminated to the front housing assembly of the modular jack connector and with the end cap assembly positioned on the shielded twisted-pair cable.

Cable 90 is a multi-conductor shielded cable that includes eight individual wires 91 with pairs of the eight wires twisted together to form four twisted pairs of wires. Cable 90 includes outer conductive shield member 92 and drain or ground wire 93 that extends along cable 90 and inside outer shield 92. Outer insulative cover or sheath 94 is positioned on the outside of cable 90 and extends the length thereof. As depicted in FIGS. 3-4, outer shield 92 and drain wire 93 have been folded back over sheath 94 in order to depict the manner in which cable 90 is typically prepared for termination to modular jack assembly 30.

End cap 50 acts as an outer shield or ground member and has a box-like shape with receptacles or openings at the front end 50*a* and oppositely facing rear end 50*b*. Receptacle 51 in the rear face 50*b* of end cap 50 is configured to receive cable engaging member 60 in the form of a cable shield clamping structure as well as receive cable 90 therein. End cap 50 includes a pair of forwardly extending flexible arms 52 that have windows or openings 52*a* that receive latch projections 45*b* that extend from the sides of outer shield member 45 of front housing assembly 35 in order to secure end cap assembly 36 to front housing assembly 35.

Figure 13:
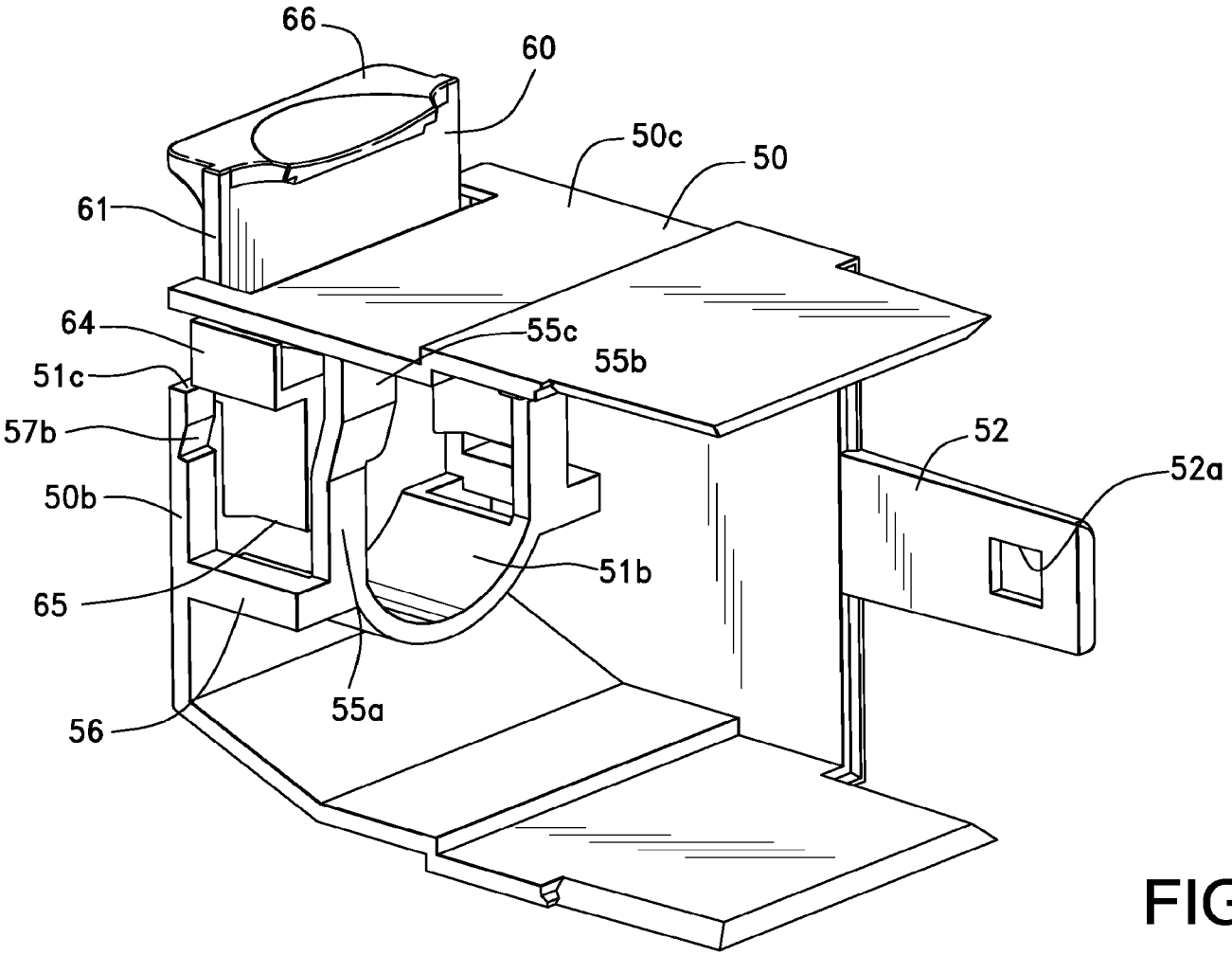
FIG. 13 is a sectioned perspective view of the end cap and cable clamp of FIG. 12B with a portion of the outer wall removed for clarity.

Receptacle 51 in rear wall 50*b* of end cap 50 is generally rectangular except that it includes arcuate lower surface 51*b* that functions as a fixed shoulder to engage cable shield 92. Receptacle 51 further includes pair of rectangular notches 51*c* adjacent top surface 50*c* of end cap 50. Pair of spaced apart inner walls 55 extend upwardly from the forward (towards receptacle 37) outer edges 51*b* of arcuate lower surface 51*b* to top wall 50*c* of end cap 50. Inner walls 55 include vertical lower section 55*a*, sloped middle section 55*b* and upper section 55*c*. Pair of vertical guide slots 58 that serve as tracks or guides are formed between rear wall 50*b* and inner walls 55 along the outside of receptacle 51 and permit cable shield clamp 60 to more therein. As best seen in FIGS. 3 and 13, receptacle 51 extends through rear wall 50*b* and past inner walls 55 to permit cable 90 to extend through end cap 50. Inner walls 55 are connected to rear wall 50*c* by lateral extensions 56 that serve to both support inner walls 55 and to provide a lower stop surface for a portion of cable shield clamp 60 as described in greater detail below.

Figure 5:
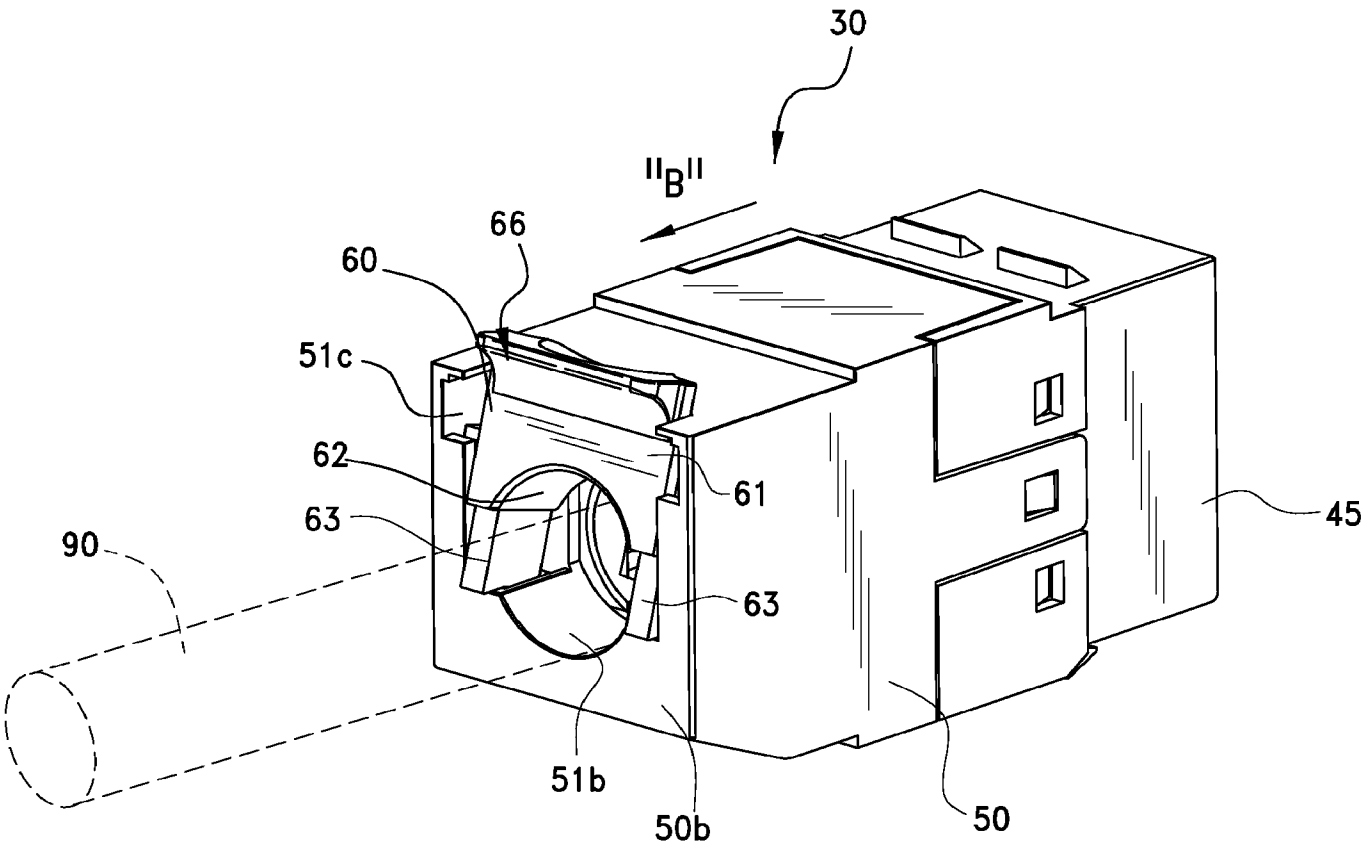
FIG. 5 is a perspective view of the shielded modular jack assembly with the end cap assembly secured to the front housing and the shielded twisted-pair cable shown in phantom.
Figure 8:
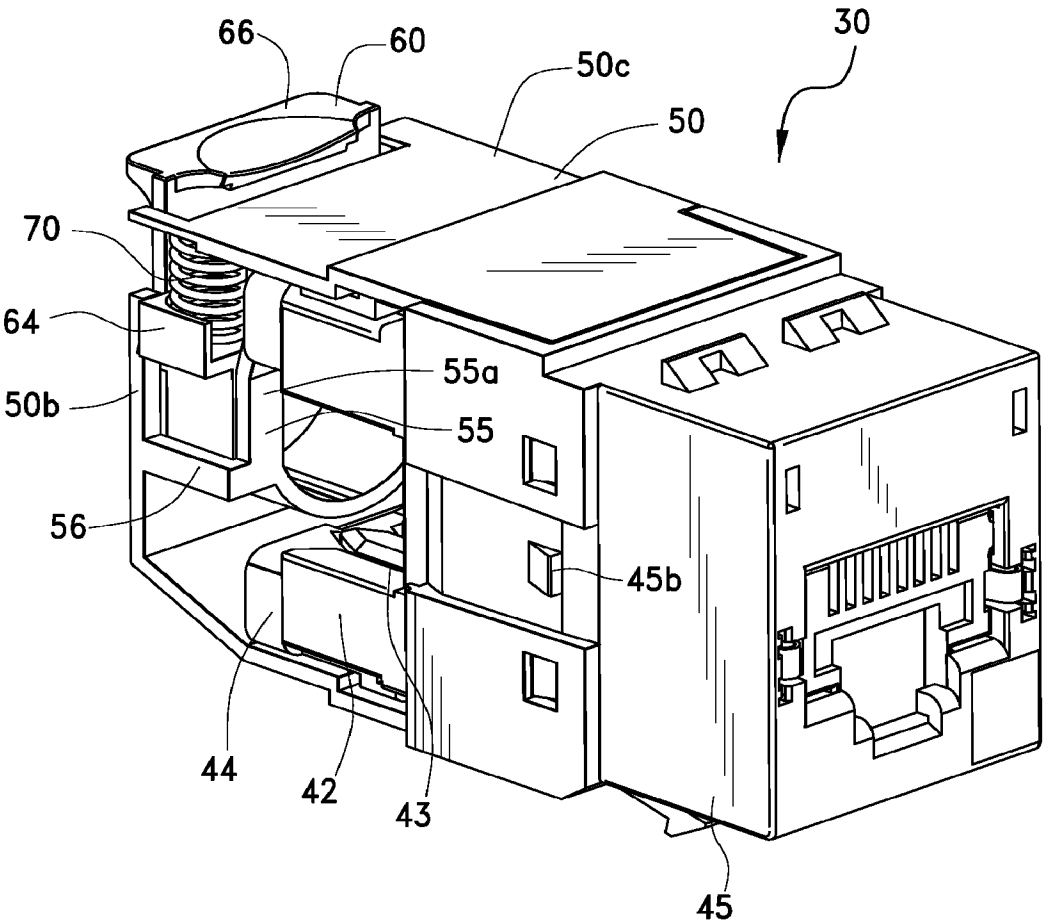
FIG. 8 is a sectioned perspective view of the shielded modular jack assembly of FIG. 5 as viewed from a front orientation of the modular jack and with a portion of the outer wall and the shielded twisted-pair cable removed for clarity.
Figure 11A:
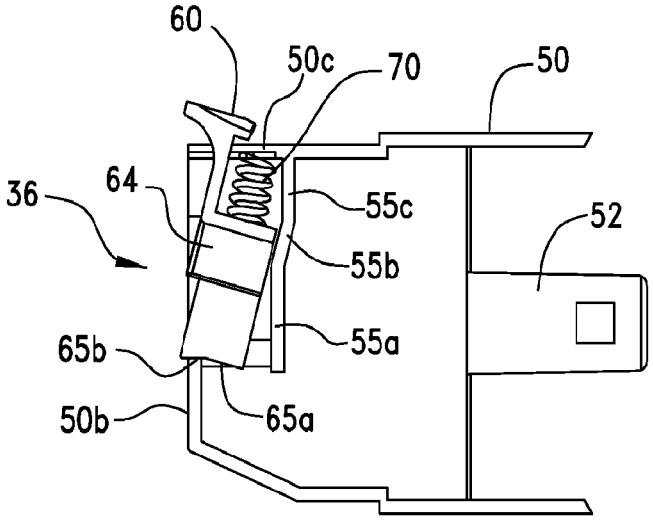
FIG. 11A is a schematic side elevation view of the end cap and cable clamp in the position depicted in FIG. 8.

The inner surface of rear wall 50*b* includes pair of retention notches 57*a* on opposite sides of opening receptacle 51 generally adjacent notches 51*c*, and further includes retention surfaces 57*b* adjacent the flat lower surface of receptacle 51 on opposite sides of arcuate lower surface 51*b*. As described in greater detail below, retention notches 57*a* and retention surfaces 57*b* act as a retention shoulder for cable shield clamp 60 when such member is moved to its open, angled position (as seen in FIGS. 5, 8 and 11A). Clearance for the angled open position is facilitated by the angled middle section 55*b* and offset upper section 55*c* of inner wall 55.

Cable shield clamp 60 includes a generally planar body 61 with an arcuate downwardly facing surface 62 for engaging cable shield 92. A pair of guide legs 63 extend downwardly from opposite sides of the body and are configured to slide within the vertical guide slots 58 of receptacle 51 of end cap 50. A pair of spring receiving pockets or receptacle blocks 64 are positioned above and extend laterally beyond guide legs 63. The lower surface 65 of guide legs 63 includes a forward section 65*a* (towards receptacle 37) that is generally perpendicular to guide legs 63 and a rear section 65*b* (away from receptacle 37) that is angled downwardly and rearwardly so that the surface of rear section 65*b* is generally parallel to retention surface 57*b* when cable shield clamp 60 is moved or rotated to its locked position as best seen in FIG. 11A. The rearward lower edge 64*a* of each spring receiving receptacle block 64 and retention notches 57*a* are dimensioned so that the rearward lower edges 64*a* are received in retention notches 57*a* when cable shield clamp 60 is in its rotated, open position and help to maintain cable shield clamp 60 in that position.

A manually manipulatable projection configured as a finger or thumb tab 66 is positioned at the top end of cable shield clamp 60 so as to be engagable by an operator's thumb or finger. End cap 50 and cable shield clamp 60 are made of a conductive material such as die cast metal but could be made of conductive or plated plastic or other conductive materials. In some instances, cable shield clamp 60 may not be conductive. A pair of springs 70 are positioned within and along vertical guide slots 58 of end cap 50 and are sandwiched between upper wall 50*c* and spring receiving receptacles 64 in order to bias cable shield clamp 60 downward towards arcuate lower surface 51*b* and also to bias cable shield clamp 60 into the retention notches 57*a* and against retention surfaces 57*b* when cable shield clamp 60 is in its open position as further described below.

Through the configuration of receptacle 51, cable shield clamp 60 and springs 70, cable shield clamp 60 is capable of moving in a linear manner up and down (generally perpendicular to the central axis of cable 90) in order to clamp engage shield 92 and drain wire 93 of cable 90 even if the diameter of cable 90 varies to some extent. In addition, cable shield clamp 60 is also configured to be tilted or pivoted out of its vertical path in order to move the cable shield clamp to an upper, open position at which cable shield clamp 60 is retained and cable 90 may be inserted through receptacle 51 and wires 91 terminated to terminals 41.

Referring to FIG. 3, when terminating cable 90 to modular jack assembly 30, cable 90 is prepared as shown with the individual twisted pairs of wires 90 separated and the outer shield 92 and drain wire 93 of cable 90 folded back over outer sheath 94. Cable 90 is slid through receptacle 51 of end cap assembly 36 with cable shield clamp 60 positioned at its open or retained position as shown in FIG. 4. The individual wires 91 are terminated to each of the terminals 41 located in insulative inner housing 40 and then stopper cap 44 is mounted onto inner housing 40 as shown in FIG. 4. End cap assembly 36 is then slid towards front housing assembly 35 along cable 90 in the direction shown by arrow "A." Flexible arms 52 slide along the outer walls of the outer shield of front housing assembly 35 until they slide over and engage the latch projections 45*b* of the outer shield and the latch projections are secured within windows 52*a* of flexible arms 52 in order to secure the front housing assembly 35 to the end cap assembly 36 as shown in FIG. 5.

Figure 6:
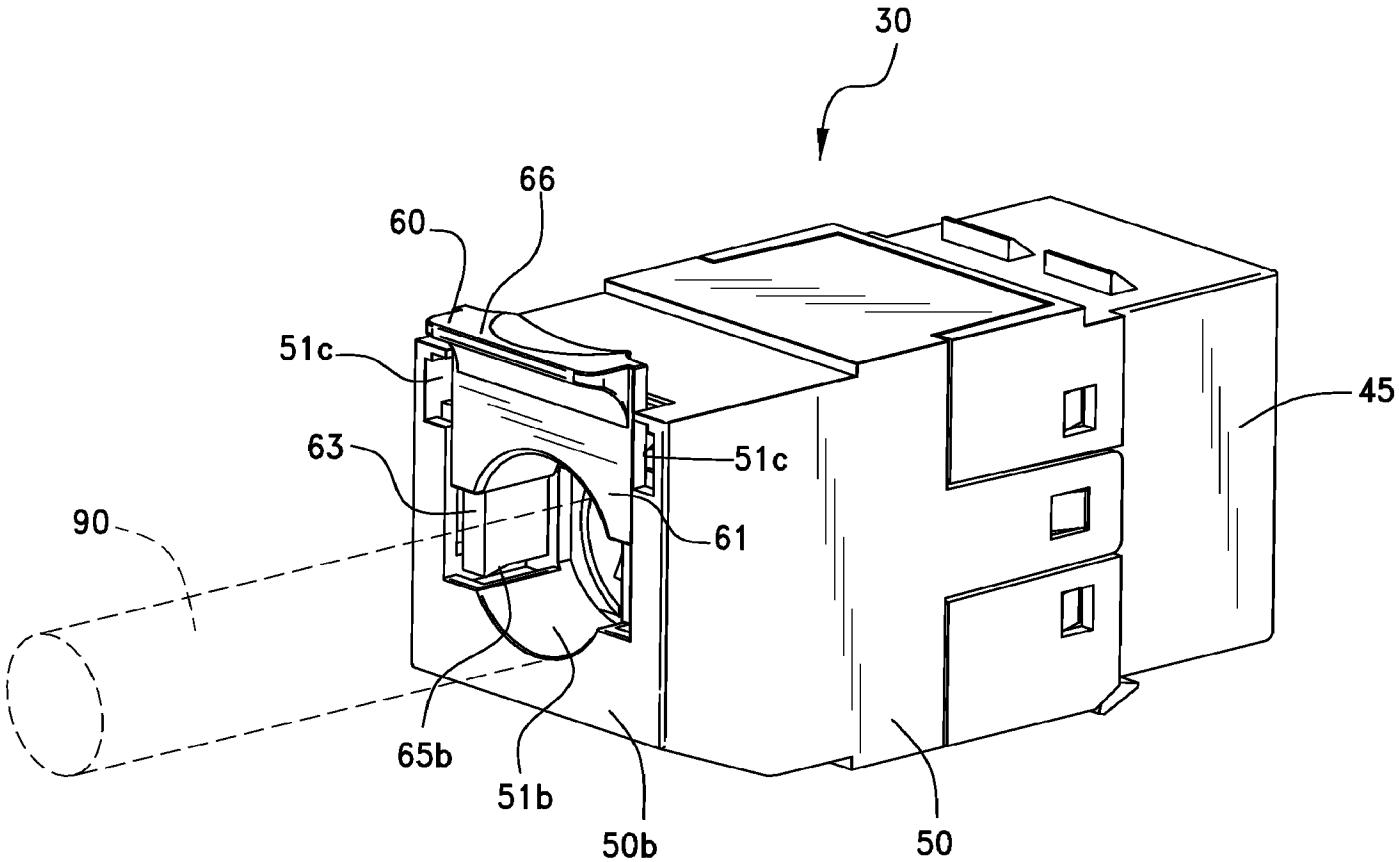
FIG. 6 is a view similar to FIG. 5, but with the cable clamp moved to an intermediate position.
Figure 7:
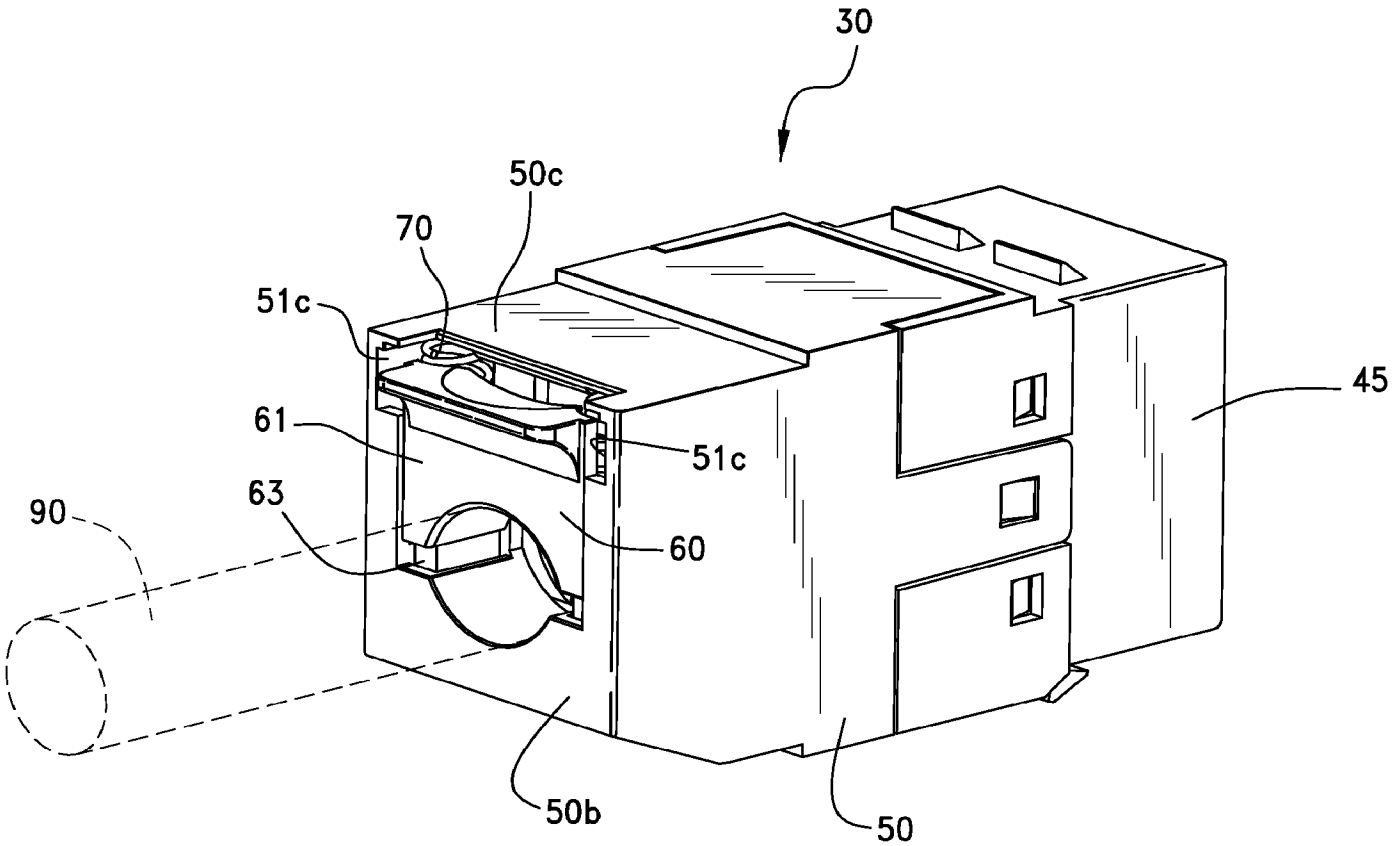
FIG. 7 is a perspective view similar to FIG. 6, but with the cable clamp moved downward and into engagement with the shield of the shielded twisted-pair cable.
Figure 9:
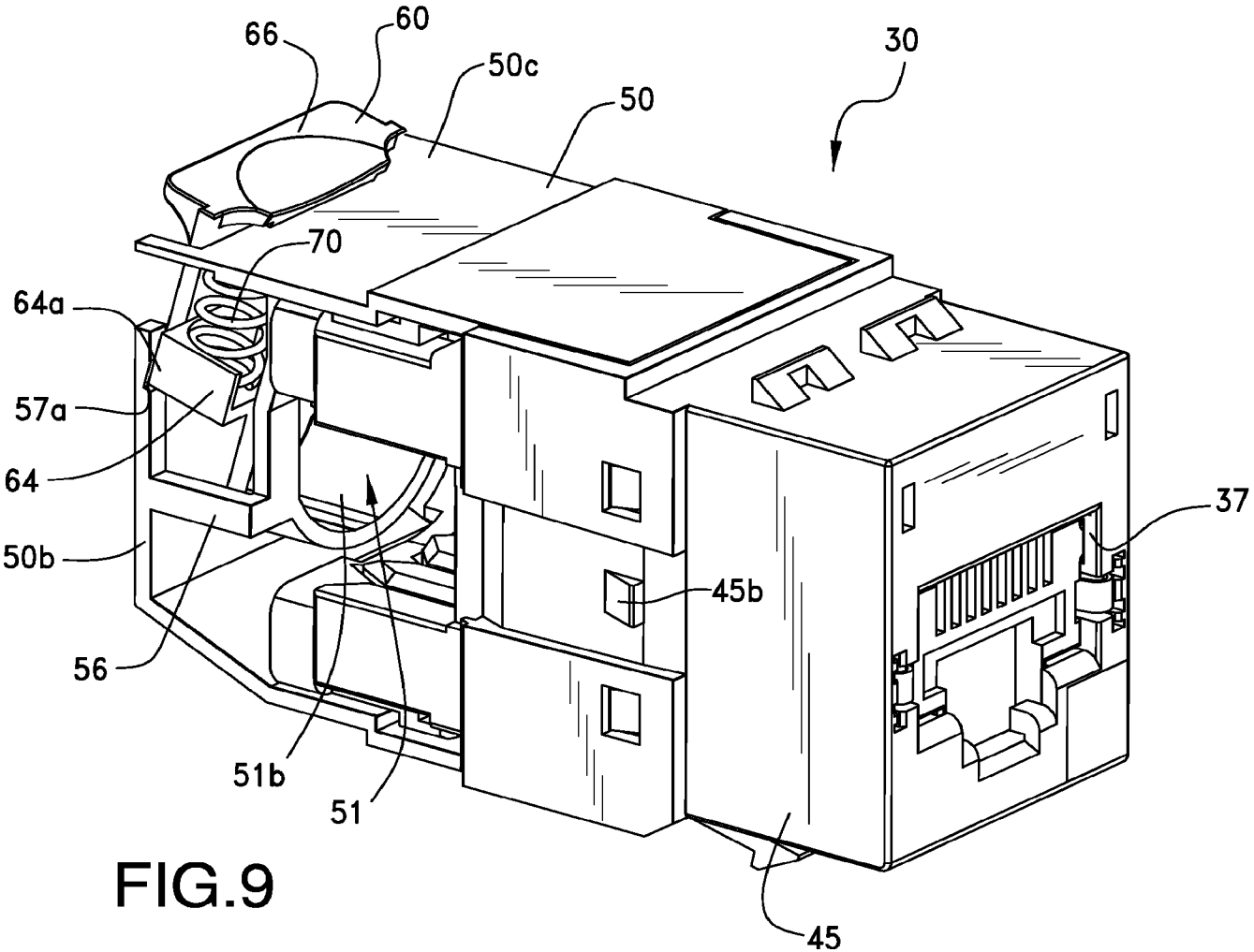
FIG. 9 is a sectioned perspective view of the shielded modular jack assembly similar to FIG. 8, but with the cable clamp in the same location as that of FIG. 6.
Figure 10:
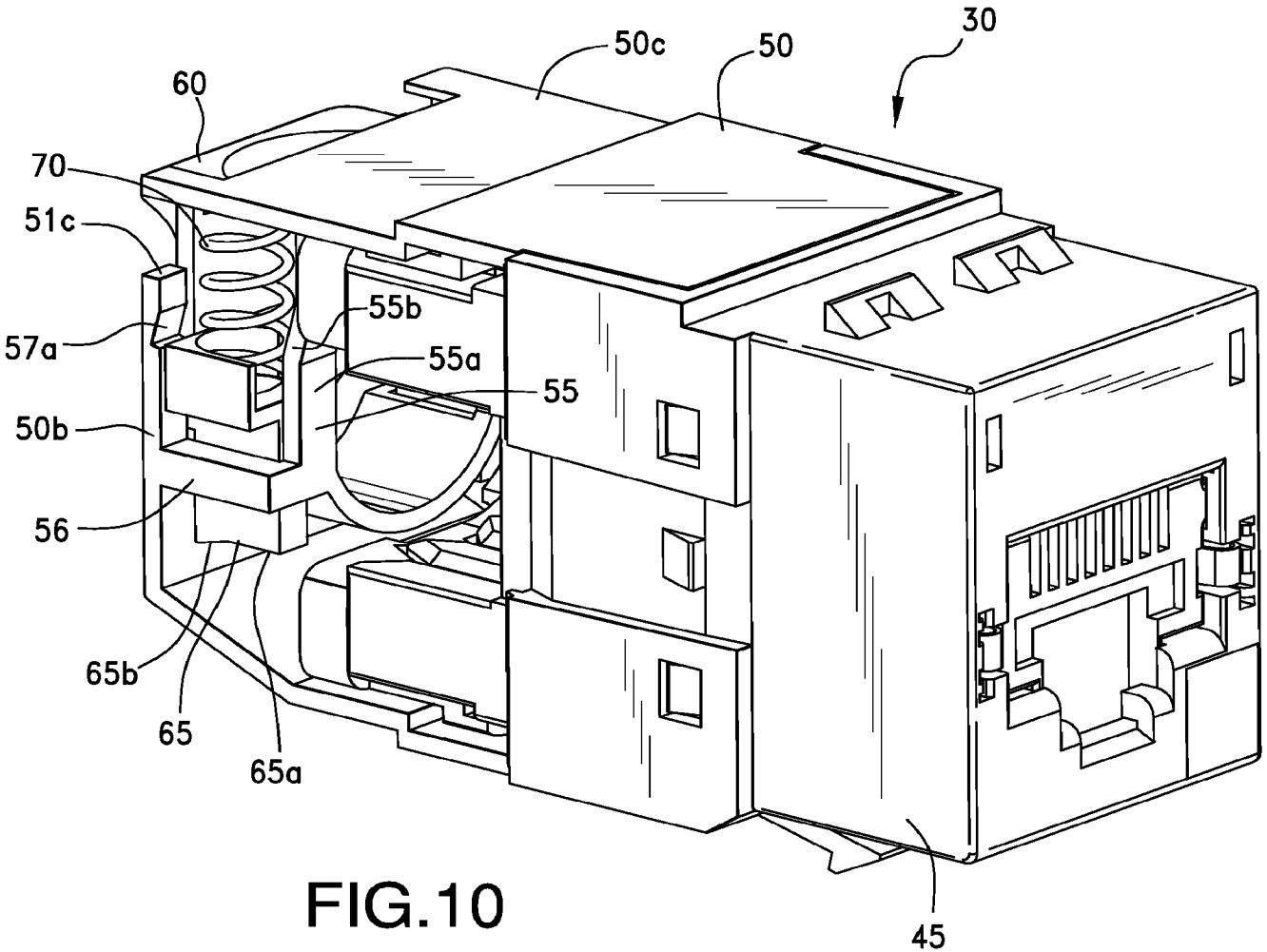
FIG. 10 is a sectioned perspective view of the shielded modular jack assembly similar to FIG. 9, but with the cable clamp in the position as shown in FIG. 7.
Figure 11B:
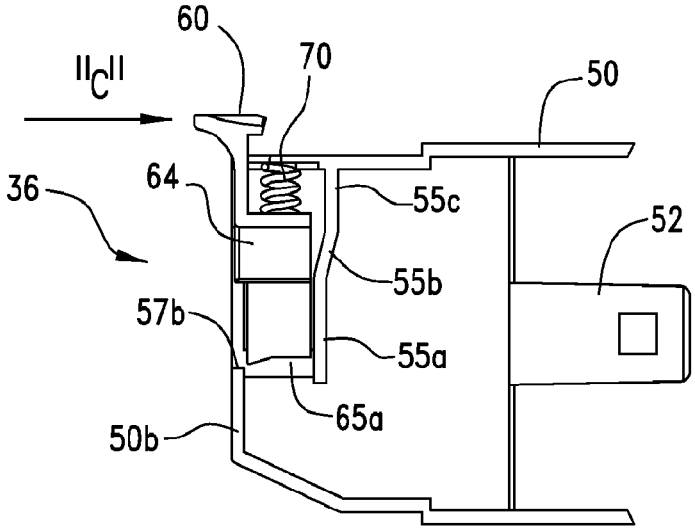
FIG. 11B is a schematic side elevation view of the end cap and cable clamp similar to FIG. 11A, but with the cable clamp moved to the location corresponding to FIG. 9.
Figure 11C:
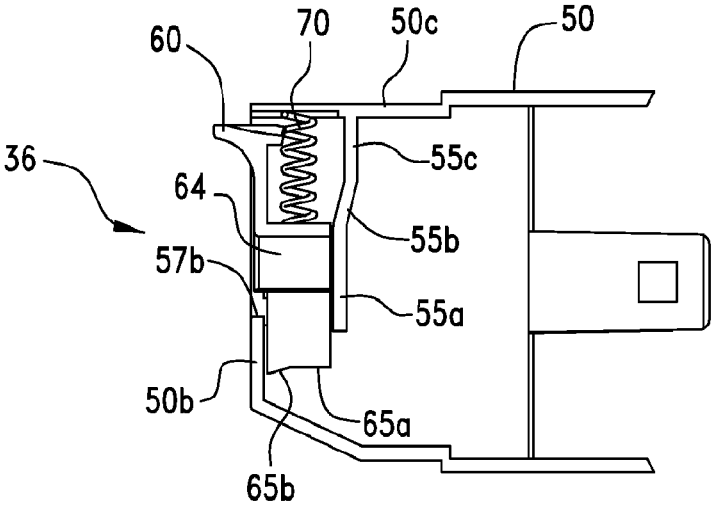
FIG. 11C is a schematic side elevation view of the end cap and cable clamp similar to FIG. 11B, but with the cable clamp moved to the location corresponding to FIG. 10.

The user then engages or presses the manually manipulatable tab 66 of cable shield clamp 60 rearwardly (away from receptacle 37) as shown by arrow "B" in FIG. 5 which forces the rear section 65*b* of each lower surface 65 of cable shield clamp 60 to slide along retention surfaces 57*b* and the rearward lower edge 64*a* of each spring receiving receptacle blocks 64 to move out of its retention notch 57*a* while compressing springs 70 so that cable shield clamp 60 moves or pivots from its angled or open position as depicted in FIGS. 5, 8 and 11A to its intermediate, vertical position as depicted in FIGS. 6, 9 and 11B. As the cable shield clamp 60 moves to the intermediate position, the springs 70 force cable shield clamp member 60 downward and into engagement with the shield 92 and drain wire 93 of cable 90 as depicted in FIGS. 7, 10 and 11C. At such position, the shield 92 and drain wire 93 engage arcuate lower surface 51*b* of end cap assembly 36 and arcuate downwardly facing surface 62 of cable shield clamp 60 in order to create a reliable electrical connection between the end cap assembly 36, the outer shield of front housing assembly 35 and shield 92 and drain wire 93 of cable 90.

Figure 12A:
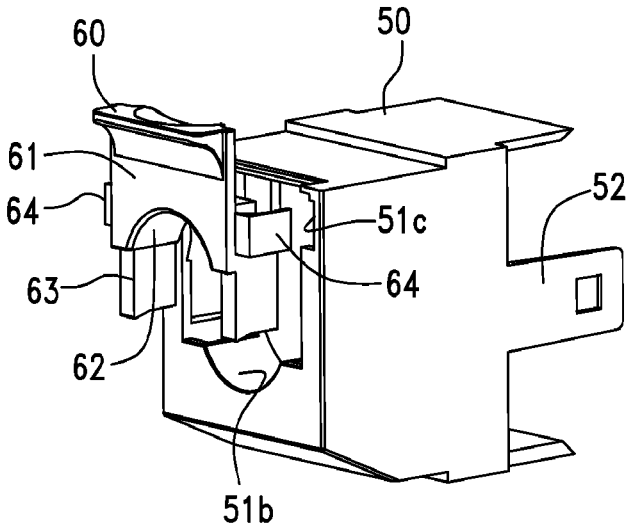
FIG. 12A is a perspective view of the end cap and the cable clamp with the cable clamp aligned and positioned prior to insertion into the end cap.
Figure 12B:
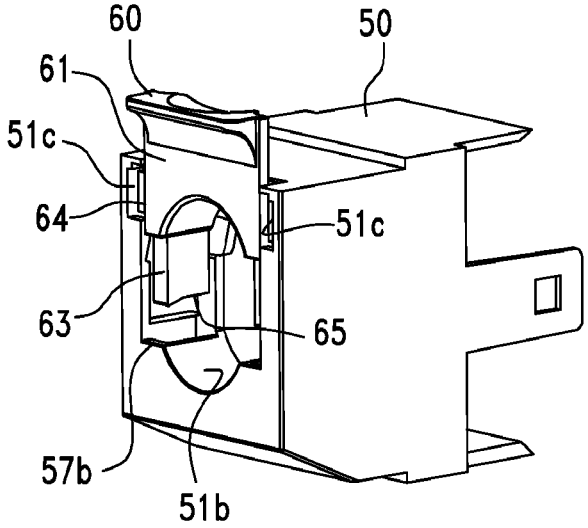
FIG. 12B is a view similar to FIG. 12A, but with the cable clamp slid horizontally into the end cap.
Figure 12C:
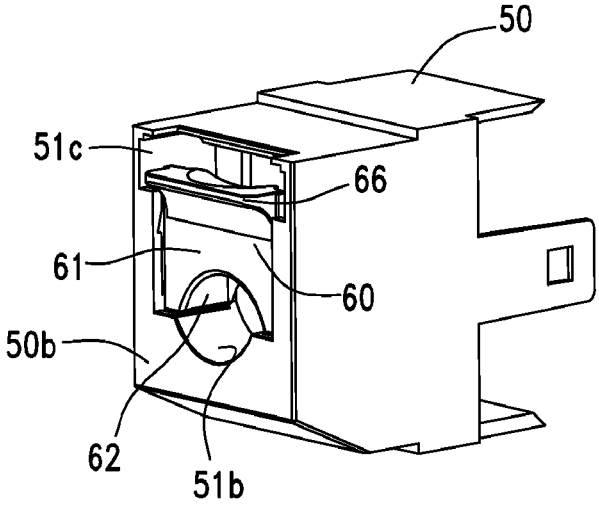
FIG. 12C is a view similar to FIG. 12B, but with the cable clamp slid vertically downward to the spring-loading position.
Figure 14:
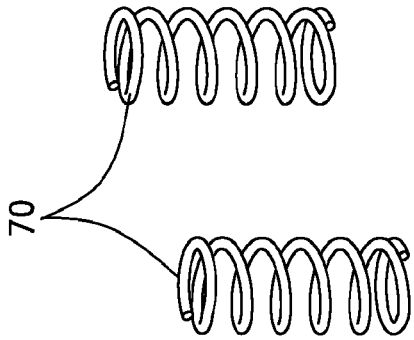
FIG. 14 is a sectioned perspective view of the end cap and cable clamp of FIG. 12C with a portion of the outer wall removed for clarity and with a pair of springs in position for insertion into the end cap and cable clamp assembly.
Figure 14:
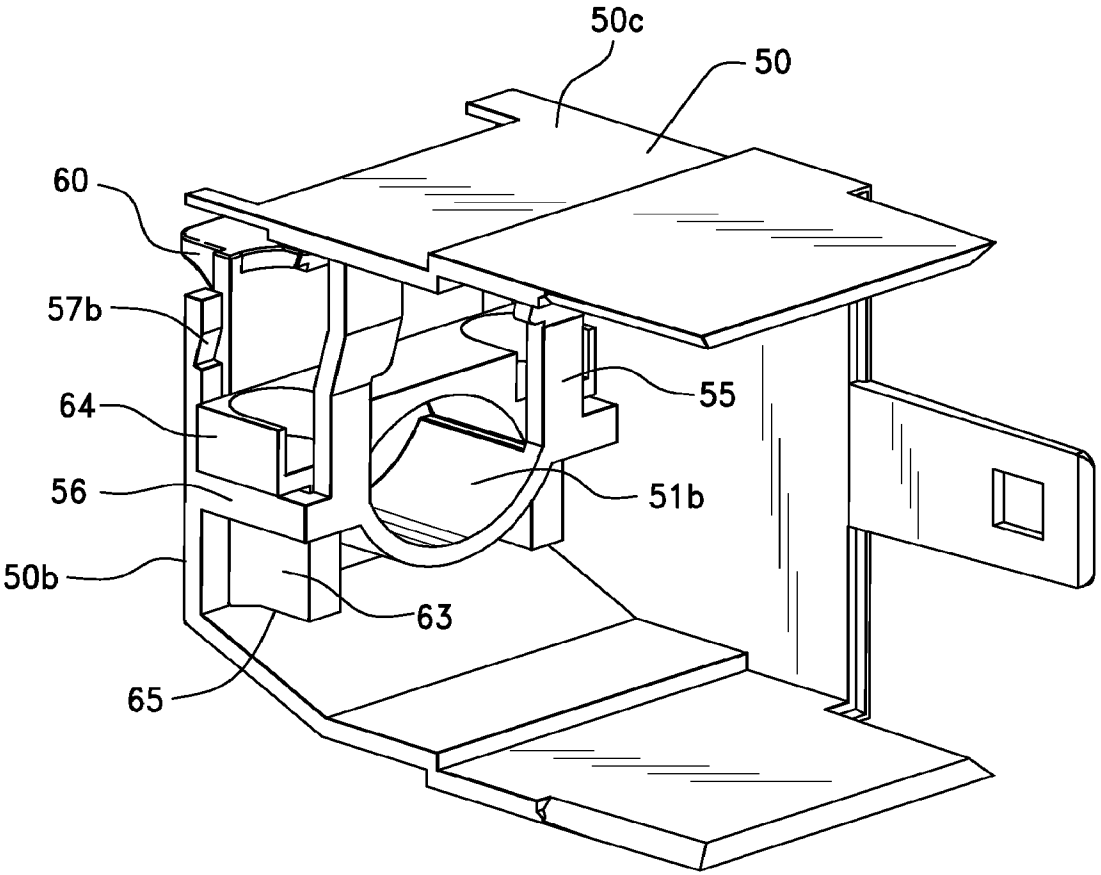
Figure 15:
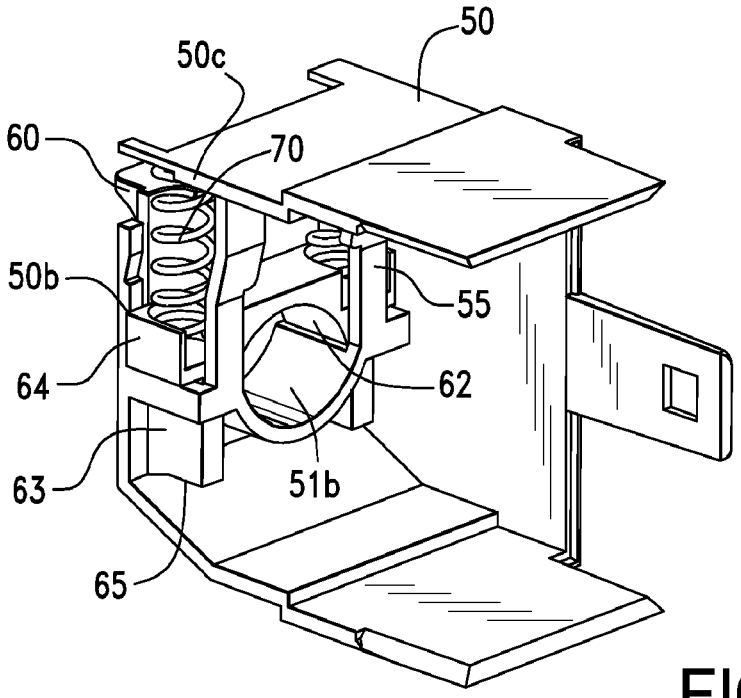
FIG. 15 is a view similar to FIG. 14, but with the springs loaded into the end cap and cable clamp assembly.

Referring to FIGS. 12-6, during the assembly of shield clamp 60 into end cap assembly 36, the cable shield clamp is initially aligned with the receptacle 51 of end cap 50 so that spring receiving receptacle blocks 64 are vertically aligned with notches 51*c* of receptacle 51 depicted in FIG. 12A. Cable shield clamp 60 is then slid forward to the position depicted in FIGS. 12B and 13 with spring receiving receptacle blocks 64 positioned within notches 51*c* and guide legs 63 positioned adjacent lower section 55*a* of inner walls 55. Cable shield clamp 60 is then moved downward within receptacle 51 with spring receiving receptacle blocks sliding within vertical guide slots 58 until the lower surface of spring receiving receptacle blocks 64 engage lateral extensions 56 as depicted in FIGS. 12C and 14. At this position, springs 70 are inserted into the vertical guide slots 58 with the lower end of springs 70 being inserted into receptacle blocks 64 and the upper end of the springs engaging the upper wall 50*c* of end cap 50 as depicted in FIG. 15.

Figure 16:
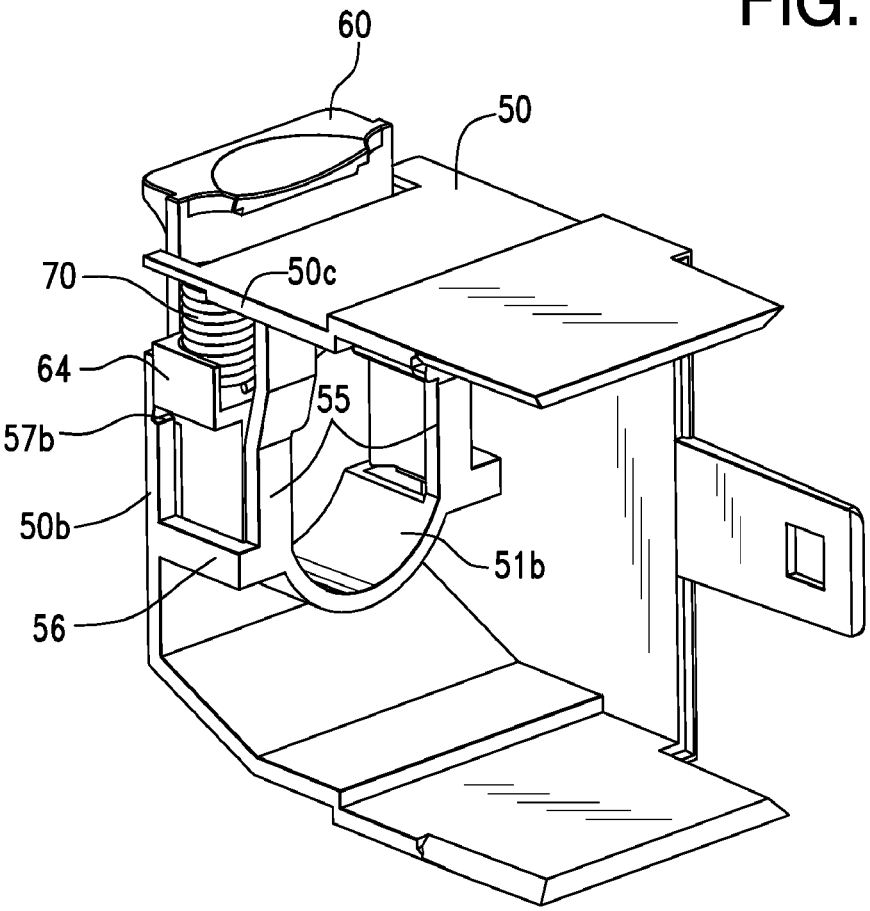
FIG. 16 is a view similar to FIG. 15, but with the clamp raised and the springs compressed to their maximum extent.

As can be seen in FIG. 16, once springs 70 are in place, their physical presence will prevent cable shield clamp 60 from moving upward to the position depicted in FIGS. 12B and 13 (whereat spring receiving receptacle blocks 65 are aligned with notches 51*c*) and thus cable shield clamp 60 may not be removed from end cap 50. However, by moving cable shield clamp 60 upward to the position shown in FIG. 16, the lower surfaces 65 of guide legs 63 are positioned above retention surface 57*b* so that pressing the manually manipulatable tab 66 in the direction of arrow "C" as shown in FIG. 11B will force cable shield clamp 60 to rotate clockwise (as viewed in FIG. 11B) and, upon removal of the operator's finger, the spring 70 will force the rear section 65*b* of lower surface 65 of guide legs 63 into engagement with retention surface 57*b* and force rearward lower edges 65*a* of receptacle blocks 65 into retention notches 57*a* in order to secure cable shield clamp 60 in the retained or open position as shown in FIGS. 5, 8 and 11A.

Through such a configuration, cable shield clamp 60 is configured to be retained at a first, open position (FIG. 11A) at which the cable shield clamp is positioned at an angle of approximately 15 degrees from vertical or perpendicular to the central axis of cable 90. Engagement of the tab 66 towards the rear of modular jack assembly 30 forces the lower surfaces 65 of guide legs 63 of cable shield clamp 60 to slide along retention surfaces 57*b* which causes cable shield clamp 60 to translate and pivot from the angular position depicted in FIG. 11A to the vertical position depicted at FIG. 11B. At such position, cable shield clamp 60 is unconstrained and springs 70 force cable shield clamp 60 downward along a linear path generally perpendicular to the central axis of cable 90 and towards the arcuate lower surface 51*b* of receptacle 51 so that shield 92 and drain wire 93 of cable 90 are engaged between arcuate surface 62 of cable shield clamp 60 and arcuate lower surface 51*b* of end cap 50. In other words, cable shield clamp 60 is configured for movement relative to end cap 50 in a first generally linear direction that is perpendicular to the central axis of cable 90 and along a second rotational and translational or non-linear path to a retention or open position at which the cable maybe inserted through the end cap assembly 36. This is especially useful because the end cap is slid along cable 90 after the cable has been terminated to the front housing assembly 35. As a result, the end cap assembly 36 may be slid along cable 90 and towards front housing assembly 35 with the cable shield clamp 60 in its open position (FIG. 11A) without having to manipulate or hold cable shield clamp 60. Only once the end cap assembly 36 is mounted to front housing assembly 35 is it necessary to engage cable shield clamp 60 in order to move it away from its open position so that the force provided by springs 70 causes the cable shield clamp 60 to engage shield 92 and drain wire 93 and create a reliable electrical connection between shield 92, drain wire 93 and modular jack assembly 30.

Referring to FIGS. 17-21, an additional embodiment of the modular jack and cable clamping assembly is depicted. In this embodiment, end cap 150 is a generally box-like shielding or ground structure with a receptacle 151 through which cable 90 may be inserted. An arcuate projection 156 projects rearwardly from rear wall 150*b* and forms an arcuate lower surface 151*b* that functions as a fixed shoulder against which cable shield 92 and drain wire 93 of cable 90 are forced by cable shield clamp 160. Receptacle 151 includes a pair of vertical guide slots 158 that serve as tracks or guides to permit vertical movement of cable shield clamp 160. Vertical guide slots 159 are generally defined by rear wall 150*b* and inner walls 155. Bottom 159*a* of each guide slot 159 extends along the top surface of arcuate projection 156.

Top wall 150*c* includes cantilevered projection 150*d* from which downwardly extending retention hook 159 projects. Hook 159 includes tapered rear surface 159*a* and upwardly facing latching surface 159*b*, both of which interact with cable shield clamp 160 in order to retain cable shield clamp 160 in an open position to permit insertion of cable 90 into receptacle 151.

Cable shield clamp 160 includes a body 161, a downwardly facing arcuate surface 162 for engaging cable shield 92 and drain wire 93 and a pair of relatively thin guide webs 163 that extend laterally from opposite sides of body 161 and are located within vertical guide slots 159 of end cap 150. A manually manipulatable finger or thumb tab 166 is located at the top of cable shield clamp 160 and is connected to body 161 by a pair of spaced apart, upwardly extending connecting members 165. Tab 166 includes a forward edge 166*b* that interacts with rear surface 158*a* and latching surface 158*b* of retention hook 158 and a rear edge that extends beyond cantilevered projection 150*b*. The space between the upwardly extending connecting members 165 defines an opening or receptacle 167 in which retention hook 158 is received. Inasmuch as body 161 and arcuate surface 162 are positioned immediately adjacent rear wall 150*b* of end cap 150 and the cantilevered projection 150*d* extends beyond rear wall 150*b*, connecting members 165 extend upwardly at an angle so that a portion of manually manipulatable tab 166 is accessible beyond projection 150*d*. Cable shield clamp 160 further includes a spring engaging post 168 (FIG. 20) for securing spring 170 in place.

Figure 17:
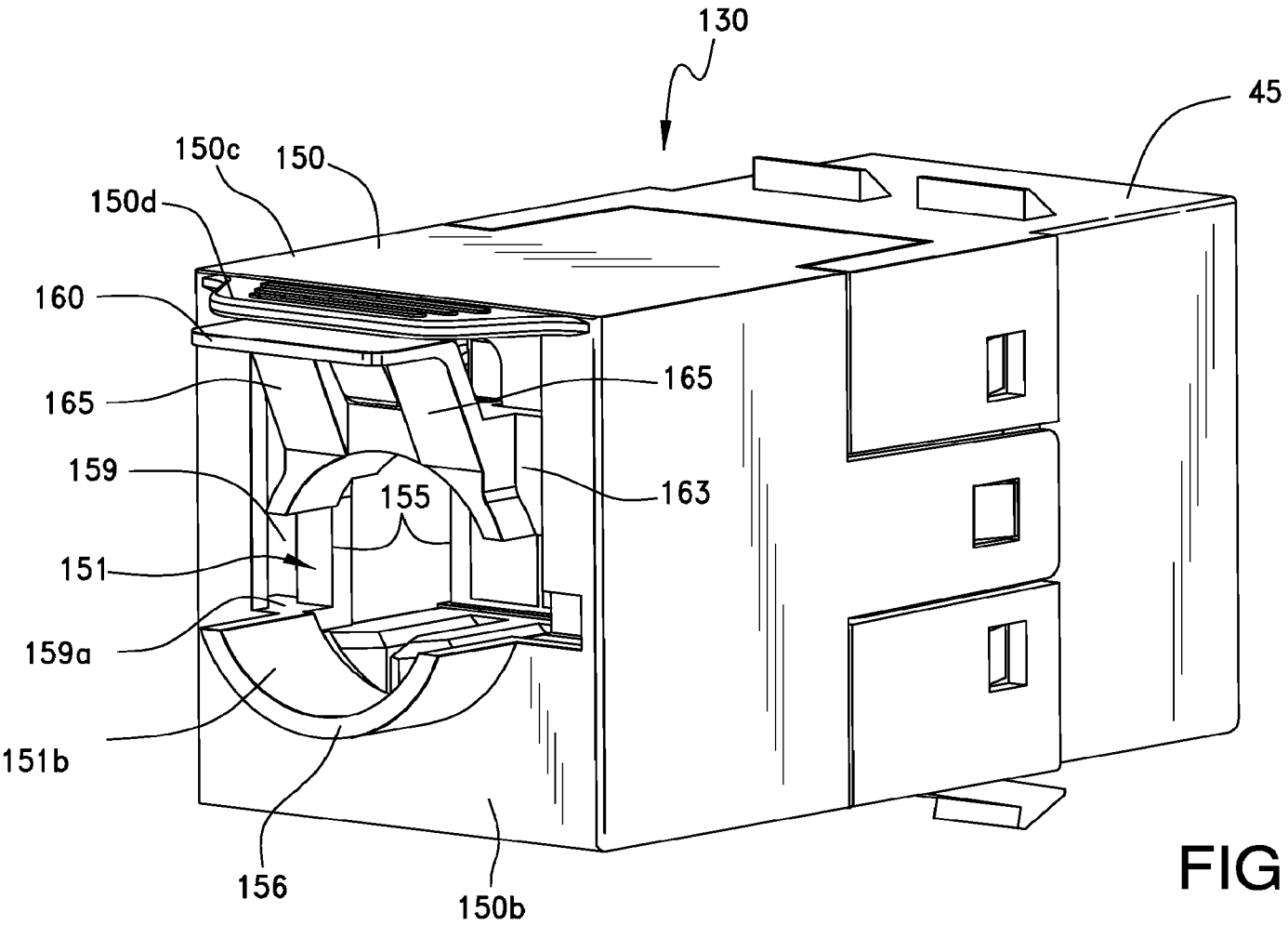
FIG. 17 is a perspective view of a modular jack assembly similar to FIG. 5, but of an alternate embodiment of the end cap and cable clamping assembly.
Figure 18:
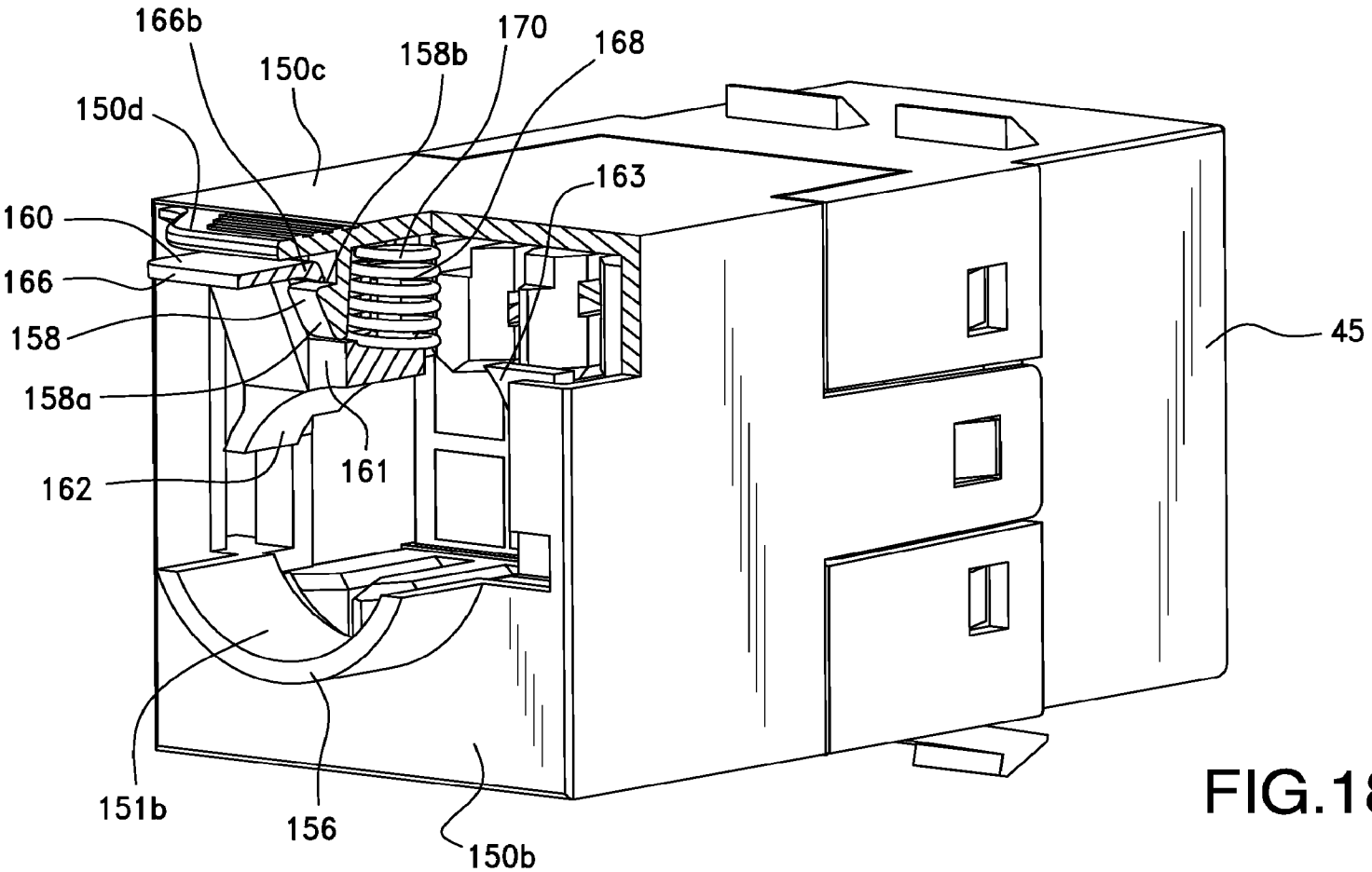
FIG. 18 is a view similar to FIG. 17, but with certain portions of the end cap and cable clamp removed for clarity.

In operation, cable shield clamp 160 is initially positioned at its open or latched position as depicted in FIGS. 17-8. In such position, the rear edge 166*b* of tab 166 engages latching surface 158*b* of retention latch 158 in order to retain or hold cable shield clamp 160 in the open position. After inserting cable 90 through receptacle 151 and terminating the individual wires 91 to the terminals of the front housing assembly, the end cap assembly 136 is slid towards front housing assembly 35 as described above with respect to the first embodiment.

Figure 19:
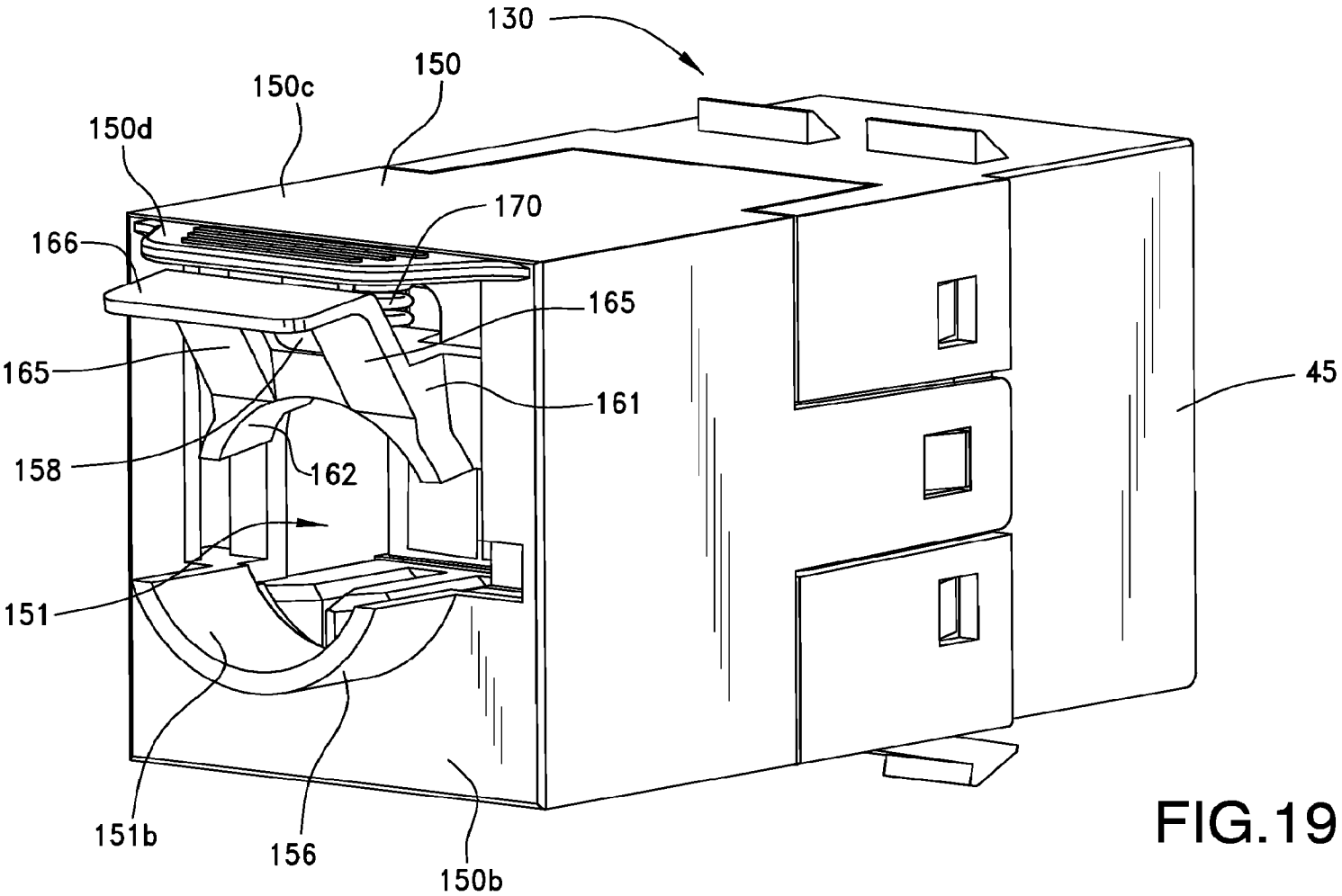
FIG. 19 is a view similar to FIG. 17, but with the clamp moved from its latched position to an intermediate position.
Figure 20:
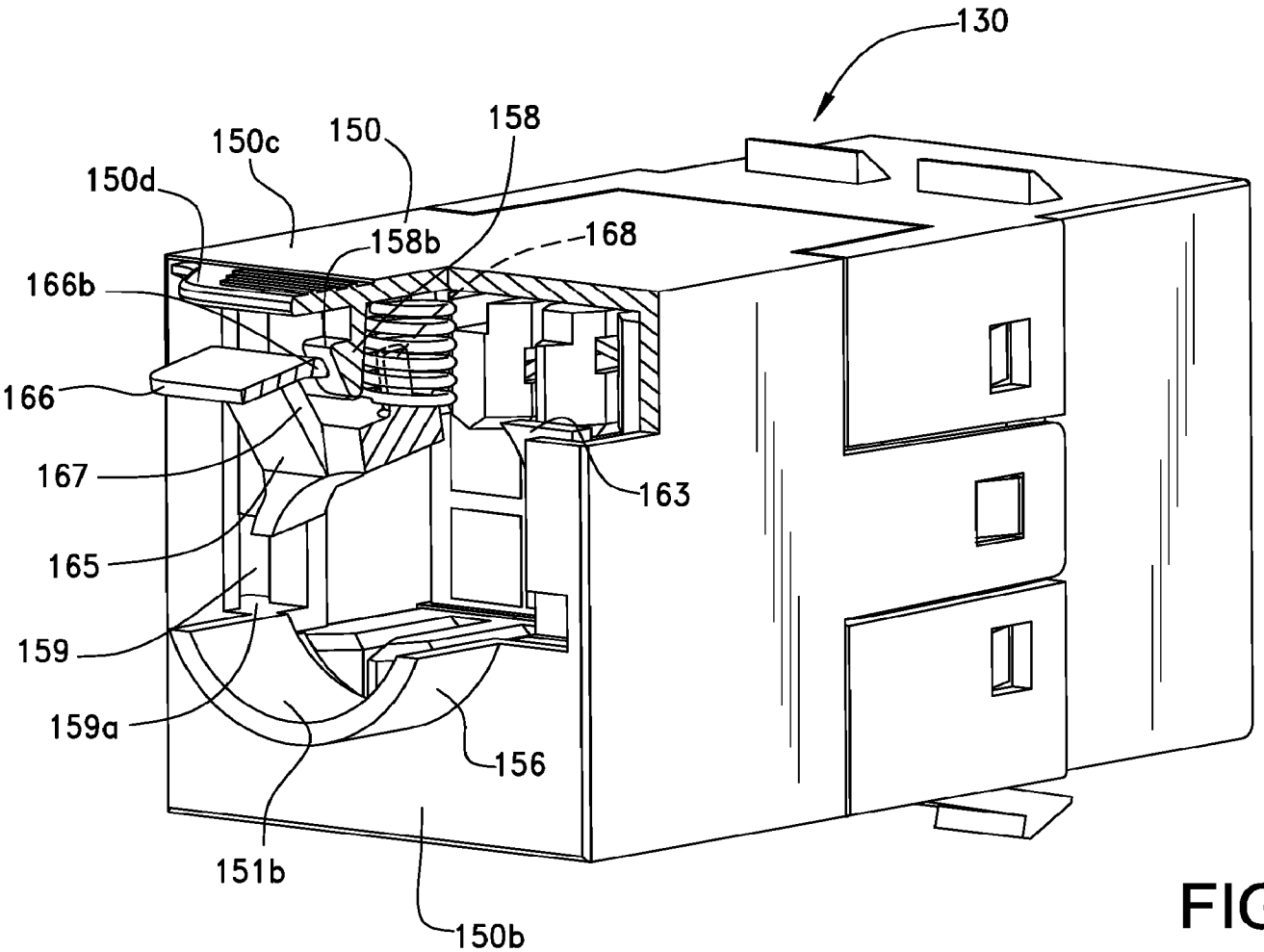
FIG. 20 is a view similar to FIG. 19, but with certain portions of the end cap and cable clamp removed for clarity.
Figure 21:
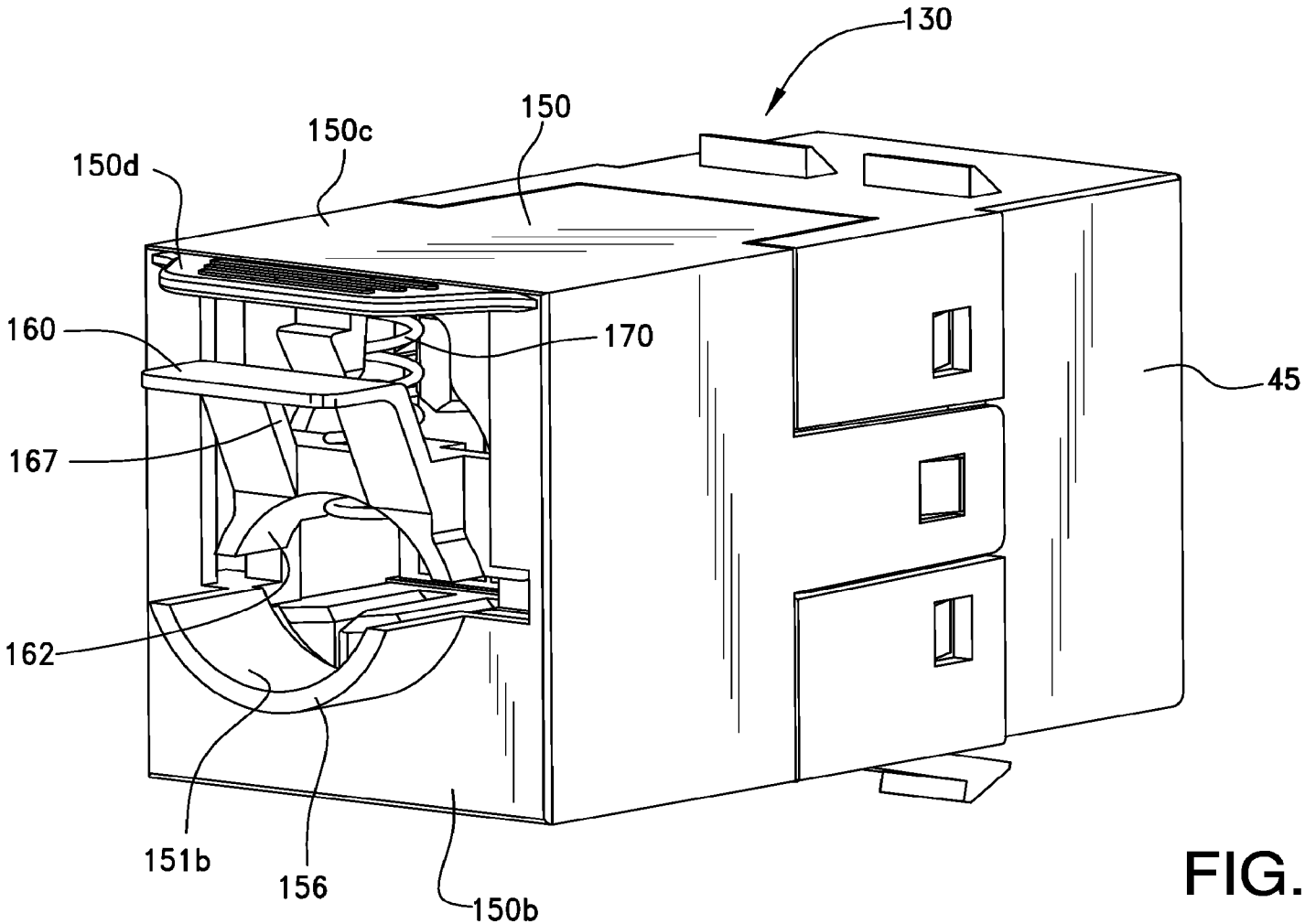
FIG. 21 is a view similar to FIG. 19, but with the cable clamp moved downward to its cable shield engaging position.

Once the front and rear housing assemblies are secured together, an operator presses the end of tab 166 downward and rearward which causes the forward edge 166*b* of tab 166 to slide along and then past the end of latching surface 158*b*. Since post 168 has spring 170 mounted thereon, cable shield clamp 160 will tend to rotate as tab 166 moves along latching surface 158*b*. The amount of rotation of cable shield clamp relative to translation can be controlled by the size of spring 170. It should be noted that guide webs 163 are sufficiently thinner than vertical guide slots 157 in order to permit cable shield clamp 160 to rotate slightly so as to disengage cable shield clamp 160 from hook 158 as depicted in FIGS. 19-20. As depicted in FIG. 21, once forward edge 166*b* of tab 166 has moved past latching surface 158*b* of hook 158, spring 170 forces cable shield clamp 160 downward while webs 163 slide in guide slots 157 so that arcuate surface 162 of cable shield clamp 160 and arcuate lower surface 151*b* of end cap assembly 150 engage shield 92 and drain wire 93 of cable 90 therebetween in order to create a reliable electrical connection between the shield 92, drain wire 93 and connector assembly 130.

As can be seen, cable shield clamp 160 of modular jack assembly 130 is initially removed along the top latching surface 158*b* of hook 158 which causes cable shield clamp to slide or rotate along such latching surface until the forward edge 166*b* has moved past the edge of latching surface 158*b*. At such point, forward edge 166*b* of tab 166 slides along rear surface 158*a* of hook 158 as cable shield clamp 160 moves downward and may rotate slightly back towards a vertical orientation. Once forward edge 166*b* moves lower than the bottom of hook 158, cable shield clamp 160 slides linearly in a direction generally perpendicular to the central axis of cable 90 in order to clamp cable 90 between arcuate lower surface 151*b* and arcuate surface 162 and create a reliable electrical connection between end cap assembly 136, the outer shield of front housing assembly 35 and shield 92 and drain wire 93 of cable 90.

During assembly, when it is desired to move cable shield clamp 160 from its lower cable engaging position as depicted in FIG. 21 to its open position as depicted in FIG. 17, tab 166 is pressed upward so that forward edge 166*b* of tab of 166 slides along rear angled surface 158*a* of hook 158 as cable shield clamp 160 moves upward. Once the forward edge 166*b* passes the upward edge of rear surface 158*a*, the spring force of spring 170 will cause cable shield clamp 160 to rotate with forward edge 166*b* of tab 166 sliding onto latching surface 158*b* of hook 158 in order to secure cable engaging member 160 in its open position as depicted in FIGS. 17-8.

In still additional embodiments, the end cap 50 and cable shield clamp 60 of the first embodiment could be modified so that the cable shield clamp is only configured for vertical movement (i.e., perpendicular to the central axis of cable 90). In such case, a hole or pair of holes (not shown) would be formed in end cap 50 and a similar hole or holes formed in cable shield clamp 60 that would be aligned when the cable shield clamp is in a raised position so that arcuate surface 62 of cable shield clamp 60 is spaced from arcuate lower surface 51*b* of receptacle 51 in order to permit cable 90 to be inserted into receptacle 51 as depicted in FIGS. 6 and 8. A pin (not shown) or other similar structure would be inserted through the aligned holes in order to maintain the cable shield clamp 60 in the raised position until the user desires to remove the pin from the holes and permit the force provided by springs 70 to force cable shield clamp 60 downward and into engagement with shield 92 and drain wire 93 of cable 90. As an example, the holes in the cable shield clamp 60 could be located in guide legs 63 and the aligned holes located in lower section 55*a* of inner wall 55 of end cap 50. With respect to the second embodiment disclosed in FIGS. 17-21, hook 158 could be removed and a hole or holes formed in cable shield clamp 160 that would be aligned with a hole or holes in end cap 150 when cable shield clamp 160 is in its raised positioned as depicted in FIGS. 17-8. A pin (not shown) or other similar structure would be inserted through the aligned holes in order to maintain the cable shield clamp 160 in the raised position until the user desires to remove the pin from the holes and permit the force provided by spring 170 to force cable shield clamp 160 downward and into engagement with shield 92 and drain wire 93 of cable 90. In such alternate configurations, the cable shield clamps would move in a single, generally linear path upon removal of the pin or other retention structure.

All references, including publications, patent applications and patents, cited herein are hereby incorporated by reference to the same extent as if each reference were individually and specifically indicated to be incorporated by reference and were set forth in its entirety herein.

The use of the terms "a," "an" and "the" and similar referents in the context of describing the disclosure (especially in the context of the following Claims) are to be construed to cover both the singular and the plural, unless otherwise indicated herein or clearly contradicted by context. The terms "comprising," "having," "including" and "containing" are to be construed as open-ended terms (i.e., meaning "including, without limitation,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation to the scope thereof unless otherwise claimed. No language herein should be construed as indicating any non-claimed element as essential to the practice of the disclosure.

The preferred embodiments are described herein, including the best mode known to the inventors for carrying out the disclosure. Variations of those preferred embodiments may become apparent to those of ordinary skill in the art upon reading the foregoing description. The inventors expect skilled artisans to employ such variations as appropriate, and the inventors intend for the disclosure to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

The invention claimed is:

1. A field terminable electrical connector for use with a cable including an exposed outer conductive shield and an plurality of inner wires, comprising:

an insulative housing member;

a plurality of conductive terminals mounted to the housing member for interconnection to the plurality of inner wires;

a conductive ground shield at least partially surrounding the housing member;

a cable receptacle for engaging the exposed conductive shield, the cable receptacle defined in part by a conductive shoulder electrically connected to the conductive ground member;

a movable clamping member mounted on the ground member, the clamping member being configured for movement between an open position spaced from the cable receptacle to permit insertion of the cable into the receptacle and an engagement position adjacent to the cable receptacle and opposed to the conductive shoulder to clampingly engage the exposed conductive shield between the conductive shoulder and the movable clamping member;

a biasing member for biasing the movable clamping member towards the cable receptacle; and a latching structure interacting with the movable clamping member for retaining the movable clamping member at the open position.

2. The field terminable electrical connector of claim 1, wherein the movable clamping member is conductive and includes an arcuate surface for engaging the cable.

3. The field terminable electrical connector of claim 1, wherein the latching structure includes a retention shoulder and the biasing member further biases the clamping member against the shoulder in order to retain the clamping member in the open position.

4. The field terminable electrical connector of claim 1, wherein the movable clamping member moves along a first path between a first operative position spaced from the cable receptacle and the engagement position, the movable clamping member being configured for further movement along a second path intersecting with the first path, the second path including the open position.

5. The field terminable electrical connector of claim 4, wherein the first path is generally linear.

6. The field terminable electrical connector of claim 4, wherein the clamping member is retained at the open position at an angle to the first path.

7. The field terminable electrical connector of claim 4, wherein the movement of the clamping member from the open position to the first operative position includes pivotal movement.

8. The field terminable electrical connector of claim 7, wherein the clamping member moves along the second path between the first operative position spaced from the cable receptacle and the open position.

9. The field terminable electrical connector of claim 1 wherein the ground shield includes a clamp receptacle for receiving the clamping member and biasing member therein, the clamp receptacle having first and second openings on opposite sides thereof, the first opening being configured to permit insertion of the clamping member into the clamp receptacle and the second opening being configured to permit insertion of the biasing member into the clamp receptacle.

10. The field terminable electrical connector of claim 1, wherein the conductive shoulder is integrally formed with and fixed relative to the conductive ground member.

11. The field terminable electrical connector of claim 1, wherein the conductive shoulder is arcuate.

12. An electrical connector for use with a cable including an exposed outer conductive shield and an plurality of inner wires, comprising:

an insulative inner housing member;

a plurality of conductive terminals mounted to the housing member for interconnection to the plurality of inner wires;

a conductive ground shield at least partially surrounding the housing member and having a cable receiving shoulder to at least partially define a cable receiving receptacle at which the exposed section of the outer conductive shield of the cable may be positioned;

a movable shield engaging member having an engagement surface configured for movement between an open position spaced from the cable receptacle to permit insertion of the cable into the receptacle and an engagement position adjacent to the cable receptacle and opposed to the cable receiving shoulder to force the exposed conductive shield into engagement with the cable receiving shoulder;

a retention shoulder; and a biasing member for biasing the engagement shoulder of the movable shield engaging member towards the cable receiving shoulder and for biasing the shield engaging member against the retention shoulder in order to retain the shield engaging member at the open position.

13. The electrical connector of claim 12, wherein the movable shield engaging member is movable along a first path between a first operative position spaced from the cable receiving receptacle and the engagement position, the movable shield engaging member being further configured for movement along a second path between the open position and a fourth operative position at which the first and second paths intersect.

14. The electrical connector of claim 13, wherein the first path is generally linear.

15. The electrical connector of claim 14, wherein the shield engaging member is retained at the retention position at an angle to the first path.

16. The electrical connector of claim 13, wherein the movement of the shield engaging member from the retention position to the first operative position includes pivotal movement.

17. The electrical connector of claim 12, wherein the cable receiving shoulder is arcuate.

18. The electrical connector of claim 12, wherein the movable shield engaging member is conductive and is configured to engage a portion of the exposed conductive shield of the cable.

19. The electrical connector of claim 18, wherein the engagement shoulder of the movable shield engaging member is arcuate.

20. An electrical connector comprising:

a conductive member having a conductor receiving shoulder to at least partially define a conductor receiving receptacle at which a conductor may be positioned;

a conductive, movable conductor engaging member configured for movement along a first path between a first operative position spaced from the conductor receiving receptacle and a second operative position adjacent to the conductor receiving receptacle and opposed to the conductor receiving shoulder to engage the conductor between the conductor receiving shoulder and the movable conductor engaging member, the movable conductor engaging member being further configured for movement along a second path between a third operative position at which the movable conductor engaging member is retained to permit insertion of a conductor into the conductor receiving receptacle and a fourth operative position at which the first and second paths intersect;

a retention shoulder; and a biasing member for biasing the movable conductor engaging member towards the conductor receiving receptacle when the movable conductor engaging member is positioned along the first path and for biasing the conductor engaging member against the retention shoulder in order to retain the conductor engaging member at the third operative position.

21. A field terminable electrical connector for use with a cable including an exposed outer conductive shield and an plurality of inner wires, comprising:

an insulative housing member;

a plurality of conductive terminals mounted to the housing member for interconnection to the plurality of inner wires;

a conductive ground member;

a cable receptacle for engaging the exposed conductive shield, the cable receptacle defined in part by a conductive shoulder electrically connected to the conductive ground member; and a movable clamping member mounted on the ground member, the clamping member being configured for movement along a generally linear first path between a first operative position spaced from the cable receptacle and a second operative position adjacent to the cable receptacle and opposed to the conductive shoulder to clampingly engage the exposed conductive shield between the conductive shoulder and the movable clamping member, the movable clamping member being further configured for movement along a second path intersecting with the first path, the second path including a clamping member retention position at which the clamping member is retained to permit insertion of the cable into the receptacle;

a biasing member for biasing the movable clamping member towards the cable receptacle; and a latching structure interacting with the movable clamping member for retaining the movable clamping member at the retention position and at an angle to the first path.

22. The field terminable electrical connector of claim 21, wherein the conductive shoulder is integrally formed with and fixed relative to the conductive ground member.

23. The field terminable electrical connector of claim 22, wherein the conductive shoulder is arcuate.

24. The field terminable electrical connector of claim 21, wherein the conductive ground member is a ground shield at least partially surrounding the housing member.

25. The field terminable electrical connector of claim 21, wherein the movable clamping member is conductive and includes an arcuate surface for engaging the cable.

26. The field terminable electrical connector of claim 21, wherein the latching structure includes a retention shoulder and the biasing member further biases the clamping member against the shoulder in order to retain the clamping member in the retention position.

27. The field terminable electrical connector of claim 21, wherein the movement of the clamping member from the retention position to the first operative position includes pivotal movement.

28. The field terminable electrical connector of claim 27, wherein the clamping member moves along the second path between the first operative position spaced from the cable receptacle and the retention position.

29. The field terminable electrical connector of claim 21, wherein the ground member includes a clamp receptacle for receiving the clamping member and biasing member therein, the clamp receptacle having first and second openings on opposite sides thereof, the first opening being configured to permit insertion of the clamping member into the clamp receptacle and the second opening being configured to permit insertion of the biasing member into the clamp receptacle.

30. The field terminable electrical connector of claim 29, wherein the first and second openings permit the clamping member and the biasing member to be inserted into the clamp receptacle in opposite directions.

31. An electrical connector for use with a cable including an exposed outer conductive shield and an plurality of inner wires, comprising:

an insulative inner housing member;

a plurality of conductive terminals mounted to the housing member for interconnection to the plurality of inner wires;

a conductive ground shield at least partially surrounding the housing member and having a cable receiving shoulder to at least partially define a cable receiving receptacle at which the exposed section of the outer conductive shield of the cable may be positioned;

a movable shield engaging member having an engagement surface configured for movement along a generally linear first path between a first operative position spaced from the cable receiving receptacle and a second operative position adjacent to the cable receiving receptacle and opposed to the cable receiving shoulder to force the exposed conductive shield into engagement with the cable receiving shoulder, the movable shield engaging member being further configured for movement along a second path between a third operative position at which the movable shield engaging member is retained at an angle relative to the first path to permit insertion of a cable into the cable receiving receptacle and a fourth operative position at which the first and second paths intersect;

a retention shoulder; and a biasing member for biasing the engagement shoulder of the movable shield engaging member towards the cable receiving shoulder and for biasing the shield engaging member against the retention shoulder in order to retain the shield engaging member at the open position.

32. The electrical connector of claim 31, wherein the cable receiving shoulder is arcuate.

33. The electrical connector of claim 31, wherein the movable shield engaging member is conductive and is configured to engage a portion of the exposed conductive shield of the cable.

34. The electrical connector of claim 33, wherein the engagement shoulder of the movable shield engaging member is arcuate.

35. The electrical connector of claim 31, wherein the movement of the shield engaging member from the third operative position to the first operative position includes pivotal movement.

36. An electrical connector comprising:

a conductive member having a conductor receiving shoulder to at least partially define a conductor receiving receptacle at which a conductor may be positioned;

a conductive, movable conductor engaging member configured for movement along a generally linear first path between a first operative position spaced from the conductor receiving receptacle and a second operative position adjacent to the conductor receiving receptacle and opposed to the conductor receiving shoulder to engage the conductor between the conductor receiving shoulder and the movable conductor engaging member, the movable conductor engaging member being further configured for movement along a second path between a third operative position at which the movable conductor engaging member is retained at an angle to the first path to permit insertion of a conductor into the conductor receiving receptacle and a fourth operative position at which the first and second paths intersect;

a retention shoulder; and a biasing member for biasing the movable conductor engaging member towards the conductor receiving receptacle when the movable conductor engaging member is positioned along the first path and for biasing the conductor engaging member against the retention shoulder in order to retain the conductor engaging member at the third operative position.

* * * * *